US012092109B2

(12) United States Patent
Seong et al.

(10) Patent No.: US 12,092,109 B2
(45) Date of Patent: Sep. 17, 2024

(54) SCROLL COMPRESSOR

(71) Applicant: LG ELECTRONICS INC., Seoul (KR)

(72) Inventors: Sanghun Seong, Seoul (KR); Seokhwan Moon, Seoul (KR); Jinyong Jang, Seoul (KR); Sooho Jang, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 0 days.

(21) Appl. No.: 18/404,022

(22) Filed: Jan. 4, 2024

(65) Prior Publication Data

US 2024/0240637 A1 Jul. 18, 2024

(30) Foreign Application Priority Data

Jan. 12, 2023 (KR) ..... 10-2023-0004879

(51) Int. Cl.
*F04C 28/06* (2006.01)
*F04C 18/02* (2006.01)
*F04C 29/12* (2006.01)

(52) U.S. Cl.
CPC ..... *F04C 28/065* (2013.01); *F04C 18/0215* (2013.01); *F04C 29/128* (2013.01)

(58) Field of Classification Search
CPC ..... F04C 28/065; F04C 28/16; F04C 28/125; F04C 28/26; F04C 28/0292; F04C 28/12;
(Continued)

(56) References Cited

U.S. PATENT DOCUMENTS 10,458,412 B2 * 10/2019 Jin ..... F04C 18/0215
10,982,674 B2 * 4/2021 Kim ..... F04C 29/068
(Continued)

FOREIGN PATENT DOCUMENTS

KR 10-2004-0019631 3/2004
KR 10-2011-0009257 1/2011
KR 10-2017-0135193 12/2017

OTHER PUBLICATIONS

Korean Office Action dated May 10, 2024 issued in Application No. 10-2023-0004879.

*Primary Examiner* — Dapinder Singh
(74) *Attorney, Agent, or Firm* — KED & ASSOCIATES

(57) ABSTRACT

A scroll compressor is provided that may include first and second variable-capacity units that provide communication between a first intermediate pressure chamber and a low-pressure portion and between a second intermediate pressure chamber and the low-pressure portion. The first variable-capacity unit may include a first variable-capacity passage that communicates with the intermediate pressure chamber, at least one first variable-capacity valve that opens/closes the first variable-capacity passage, and a first variable-capacity opening and closing valve that controls opening/closing of the at least one first variable-capacity valve, and the second variable-capacity unit may include a second variable-capacity passage that communicates with a second intermediate pressure chamber, at least one second variable-capacity valve that opens/closes the second variable-capacity passage, and a second variable-capacity opening and closing valve that controls opening/closing of the at least one second variable-capacity valve.

20 Claims, 12 Drawing Sheets

(58) Field of Classification Search
CPC ..... F04C 15/06; F04C 15/18; F04C 15/0215; F04C 15/02; F04C 15/0261; F04C 15/0269; F04C 29/128; F04C 29/12; F04C 29/028; F04C 29/02; F04C 29/00; F04C 29/026; F04C 29/124; F04C 29/126; F04C 23/008
See application file for complete search history.

(56) References Cited

U.S. PATENT DOCUMENTS

| | | | | |
|---|---|---|---|---|
| 10,995,753 | B2 * | 5/2021 | Berning | F04C 27/005 |
| 11,326,598 | B2 * | 5/2022 | Oka | F16K 15/16 |
| 11,415,131 | B2 * | 8/2022 | Lee | F04C 29/068 |
| 11,781,546 | B1 * | 10/2023 | Jo | F04C 18/0261 418/55.1 |
| 11,953,003 | B2 * | 4/2024 | Jo | F04C 29/128 |
| 2016/0201673 | A1 * | 7/2016 | Perevozchikov | F04C 28/24 137/527 |
| 2017/0342978 | A1 | 11/2017 | Doepker | |
| 2022/0136501 | A1 * | 5/2022 | Yun | F04C 18/0253 418/55.2 |
| 2022/0235774 | A1 * | 7/2022 | Cui | F04C 18/0215 |

* cited by examiner

SCROLL COMPRESSOR

CROSS-REFERENCE TO RELATED APPLICATION(S)

Pursuant to 35 U.S.C. § 119(a), this application claims the benefit of the earlier filing date and the right of priority to Korean Patent Application No. 10-2023-0004879, filed in Korea on Jan. 12, 2023, the contents of which are incorporated by reference herein in their entirety.

BACKGROUND

1. Field

A scroll compressor, and more particularly, a variable-capacity scroll compressor is disclosed herein.

2. Background

In a scroll compressor, a fixed scroll (or non-orbiting scroll) and an orbiting scroll that configure a compression unit are engaged with each other to define a pair of compression chambers. This scroll compressor has fewer components and can rotate at high speed because suction, compression, and discharge occur continuously while the orbiting scroll rotates. Additionally, as a torque required for compression is less changed and suction and compression occur continuously, noise and vibration are low. For this reason, scroll compressors are widely applied to air conditioners.

Recently, as the severity of climate change has been highlighted, variable-capacity scroll compressors that can reduce carbon emissions have been emerging. A variable-capacity scroll compressor may vary a compression capacity depending on an operating mode of the compressor or an air conditioner, thereby improving energy efficiency by suppressing unnecessary energy loss.

The related art variable-capacity scroll compressor is equipped with a separate control device inside of a casing to vary a compression capacity. This leads to an increase in manufacturing costs as the configuration of the control device is complicated, making processing and assembly difficult.

Another variable-capacity scroll compressor has separate piping and a control device outside of a casing. This requires complicated piping outside of the casing, making processing and assembly difficult and increasing manufacturing costs. In addition, malfunction of the control device may occur and reliability may be reduced depending on a flow rate recovered from a discharge side to a suction side.

Due to the nature of these related art variable-capacity scroll compressors, there was a limit to lowering a variable-capacity ratio, which is defined as an amount of capacity reduction for a power operation, even when a partial load operation (hereinafter, referred to as a "saving operation") was performed. This may often occur in a low-speed and low-pressure ratio operation in which a compression ratio is less than 1.5.

BRIEF DESCRIPTION OF THE DRAWINGS

Embodiments will be described in detail with reference to the following drawings in which like reference numerals refer to like elements, and wherein:

FIG. 8A shows a power mode, FIG. 8B shows a first saving mode, and FIG. 8C shows a second saving mode;

DETAILED DESCRIPTION

Description will now be given in detail of a scroll compressor according to exemplary embodiments disclosed herein, with reference to the accompanying drawings.

Typically, a scroll compressor may be classified as an open type or a hermetic type depending on whether a drive unit (motor unit) and a compression unit are all installed in an inner space of a casing. The former is a compressor in which the motor unit configuring the drive unit is provided separately from the compression unit, and the latter hermetic type is a compressor in which both the motor unit and the compression unit are disposed inside of the casing. Hereinafter, a hermetic type scroll compressor will be described as an example; however, embodiments are not necessarily limited to the hermetic scroll compressor. In other words, the embodiments may be equally applied even to the open type scroll compressor in which the motor unit and the compression unit are disposed separately from each other.

In addition, scroll compressors may be classified into a vertical scroll compressor in which a rotary shaft is disposed perpendicular to the ground and a horizontal (lateral) scroll compressor in which the rotary shaft is disposed parallel to the ground. For example, in the vertical scroll compressor, an upper side may be defined as an opposite side to the ground and a lower side may be defined as a side facing the ground. Hereinafter, the vertical scroll compressor will be described as an example. However, the embodiments may also be equally applied to the horizontal scroll compressor. Hereinafter, it will be understood that an axial direction is an axial direction of the rotary shaft, a radial direction is a radial direction of the rotary shaft, the axial direction is an upward and downward (or vertical) direction, and the radial direction is a leftward and rightward direction, respectively.

Figure 1:
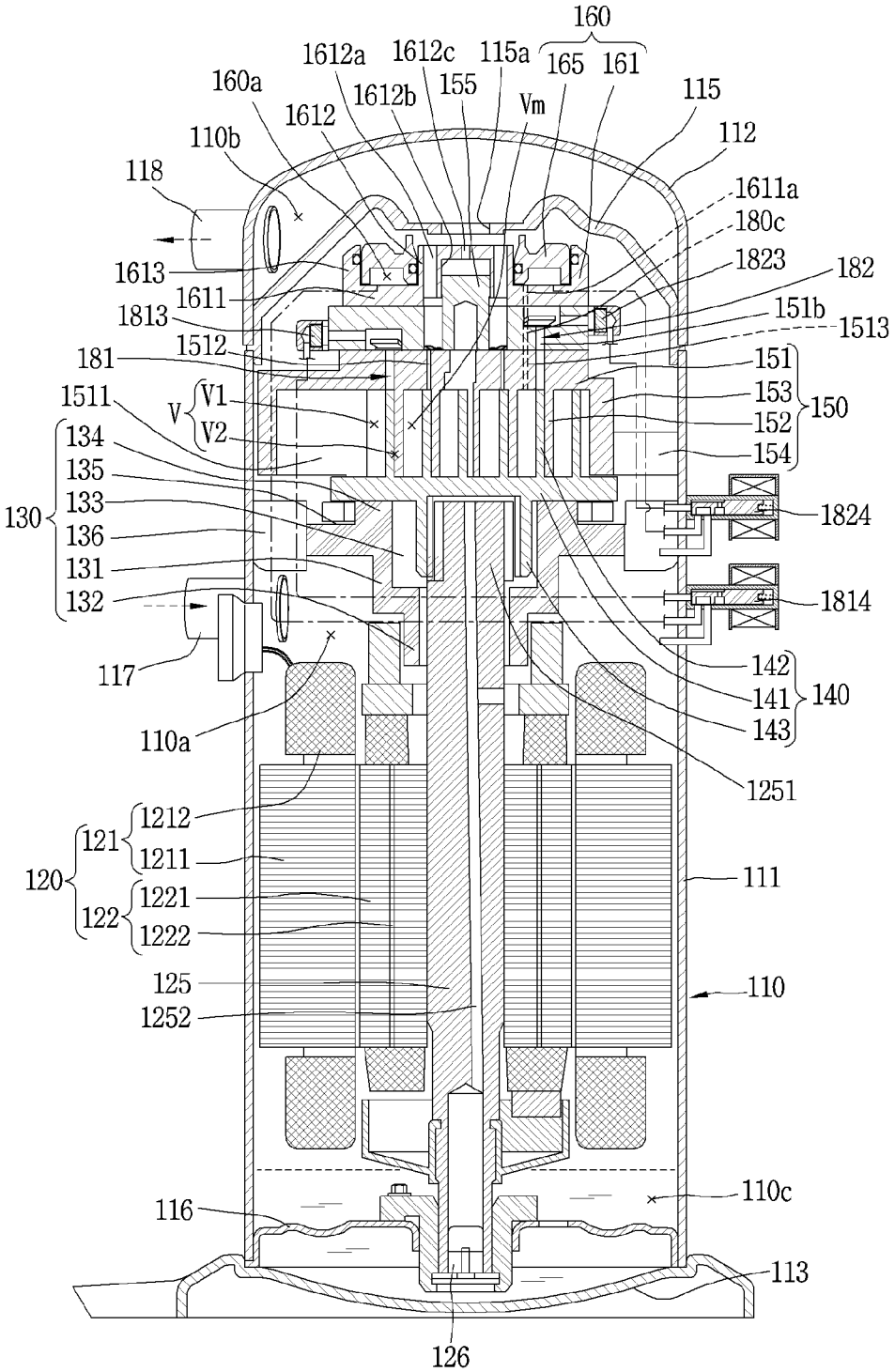
FIG. 1 is a longitudinal cross-sectional view of a scroll compressor having a variable-capacity device in accordance with an embodiment.
Figure 2:
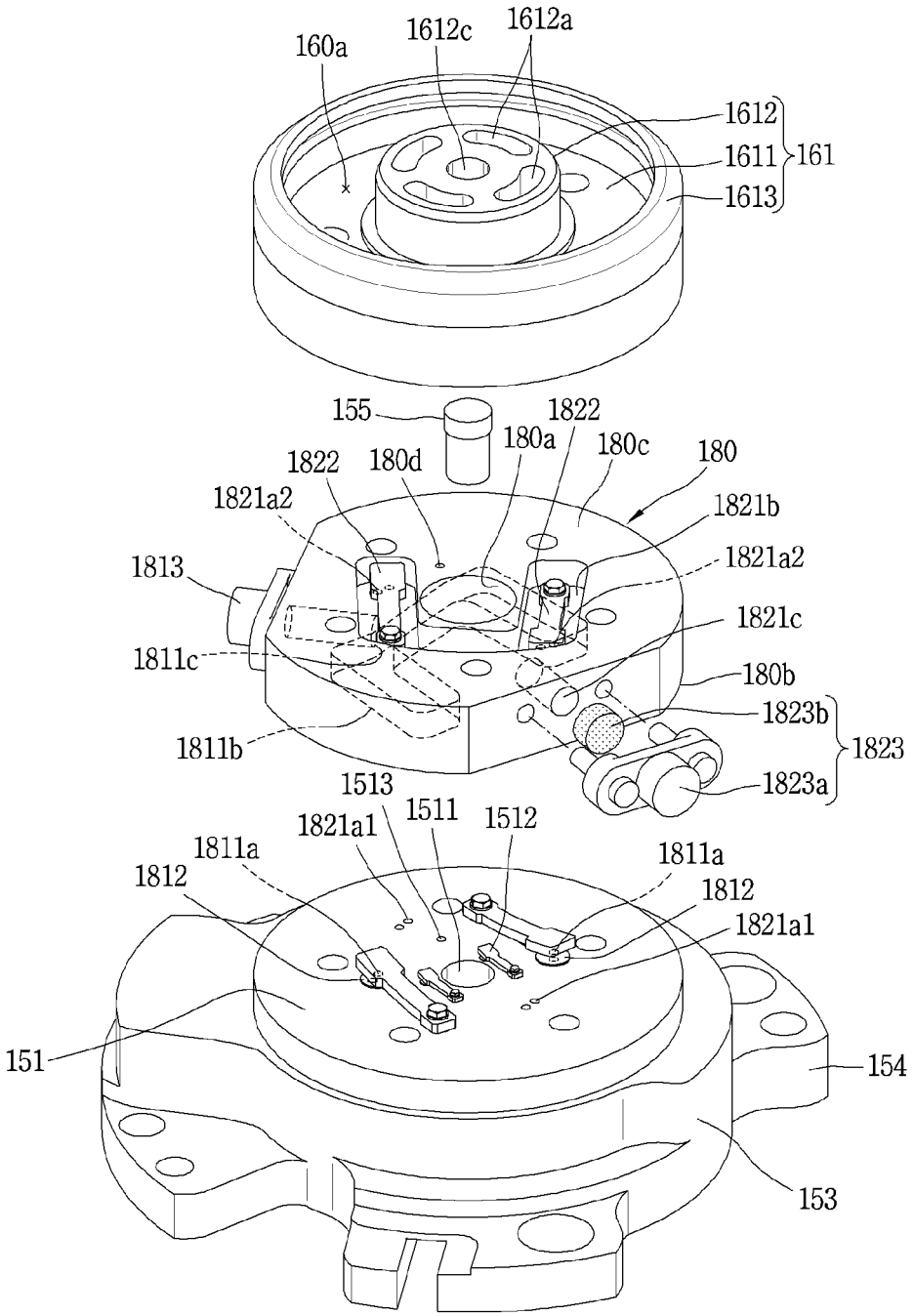
FIG. 2 is an exploded perspective view of the variable-capacity device of FIG. 1.

FIG. 1 is a longitudinal cross-sectional view of a scroll compressor having a variable-capacity device in accordance with an embodiment. FIG. 2 is an exploded perspective view of the variable-capacity device of FIG. 1.

Referring to FIG. 1, a scroll compressor according to an embodiment includes a drive motor 120 disposed in a lower half portion of a casing 110, and a main frame 130, an orbiting scroll 140, a non-orbiting scroll 150, and a back pressure chamber assembly 160 that constitute a compression unit disposed above the drive motor 120. The drive motor 120 may be coupled to one or a first end of a rotary shaft 125, and the compression unit may be coupled to another or a second end of the rotary shaft 125. Accordingly, the compression unit may be connected to the motor unit by the rotary shaft 125 to be operated by a rotational force of the drive motor 120.

The casing 110 may include a cylindrical shell 111, an upper cap 112, and a lower cap 113. The cylindrical shell 111 may have a cylindrical shape with upper and lower ends open, and the drive motor 120 and the main frame 130 may be fitted on an inner circumferential surface of the cylindrical shell 111. A terminal bracket (not illustrated) may be coupled to an upper half portion of the cylindrical shell 111. A terminal (not illustrated) that transmits external power to the drive motor 120 may be coupled through the terminal bracket. In addition, a refrigerant suction pipe 117 discussed hereinafter may be coupled to the upper portion of the cylindrical shell 111, for example, above the drive motor 120.

The upper cap 112 may be coupled to cover the open upper end of the cylindrical shell 111. The lower cap 113 may be coupled to cover the lower open end of the cylindrical shell 111. A rim of a high/low pressure separation plate 115 discussed hereinafter may be inserted between the cylindrical shell 111 and the upper cap 112 to be, for example, welded on the cylindrical shell 111 and the upper cap 112. A rim of a support bracket 116 discussed hereinafter may be inserted between the cylindrical shell 111 and the lower cap 113 to be, for example, welded on the cylindrical shell 111 and the lower cap 113. Accordingly, the inner space of the casing 110 may be sealed.

The rim of the high/low pressure separation plate 115 may be, for example, welded on the casing 110 as described above. A central portion of the high/low pressure separation plate 115 may be bent to protrude toward an upper surface of the upper cap 112 so as to be disposed above the back pressure chamber assembly 160 discussed hereinafter. A refrigerant suction pipe 117 may communicate with a space below the high/low pressure separation plate 115, and a refrigerant discharge pipe 118 may communicate with a space above the high/low pressure separation plate 115. Accordingly, a low-pressure part or portion 110*a* constituting a suction space may be formed below the high/low pressure separation plate 115, and a high-pressure part or portion 110*b* constituting a discharge space may be formed above the high/low pressure separation plate 115.

In addition, a through hole 115*a* may be formed through a center of the high/low pressure separation plate 115. The low-pressure part 110*a* and the high-pressure part 110*b* may be blocked from each other by attachment/detachment of a floating plate 165 and the high/low pressure separation plate 115 or may communicate with each other through the through hole 115*a* of the high/low pressure separation plate 115.

In addition, the lower cap 113 may define an oil storage space 110*c* together with the lower portion of the cylindrical shell 111 constituting the low-pressure part 110*a*. In other words, the oil storage space 110*c* may be defined in the lower portion of the low-pressure part 110*a*. The oil storage space 110*c* thus defines a part or portion of the low-pressure part 110*a*.

Referring to FIG. 1, the drive motor 120 according to an embodiment may be disposed in a lower half portion of the low-pressure part 110*a* and include a stator 121 and a rotor 122. The stator 121 may be, for example, shrink-fitted to an inner wall surface of the cylindrical shell 111, and the rotor 122 may be rotatably disposed inside of the stator 121.

The stator 121 may include a stator core 1211 and a stator coil 1212. The stator core 1211 may be formed in a cylindrical shape and may be shrink-fitted onto the inner circumferential surface of the cylindrical shell 111. The stator coil 1212 may be wound around the stator core 1211 and electrically connected to an external power source through a terminal (not illustrated) that is coupled through the casing 110.

The rotor 122 may include a rotor core 1221 and permanent magnets 1222. The rotor core 1221 may be formed in a cylindrical shape, and rotatably inserted into the stator core 1211 with a preset or predetermined gap therebetween. The permanent magnets 1222 may be embedded in the rotor core 1222 at preset or predetermined intervals along a circumferential direction.

In addition, the rotary shaft 125 may be, for example, press-fitted to a center of the rotor core 1221. The orbiting scroll 140 discussed hereinafter may be eccentrically coupled to the upper end of the rotary shaft 125. Accordingly, the rotational force of the drive motor 120 may be transmitted to the orbiting scroll 140 through the rotary shaft 125.

An eccentric portion 1251 that is eccentrically coupled to the orbiting scroll 140 discussed hereinafter may be formed on the upper end of the rotary shaft 125. An oil pickup 126 that suctions up oil stored in the lower portion of the casing 110 may be disposed at the lower end of the rotary shaft 125. An oil passage 1252 may be formed through an inside of the rotary shaft 125 in the axial direction.

Referring to FIG. 1, the main frame 130 may be disposed on an upper side of the drive motor 120, and, for example, shrink-fitted to or welded on an inner wall surface of the cylindrical shell 111. The main frame 130 may include a main flange portion 131, a main bearing portion 132, an orbiting space portion 133, a scroll support portion 134, an Oldham ring support portion 135, and a frame fixing portion 136.

The main flange portion 131 may be formed in an annular shape and accommodated in the low-pressure part 110*a* of the casing 110. An outer diameter of the main flange portion 131 may be smaller than an inner diameter of the cylindrical shell 111 so that an outer circumferential surface of the main flange portion 131 may be spaced apart from an inner circumferential surface of the cylindrical shell 111. However, the frame fixing portion 136 discussed hereinafter protrudes from an outer circumferential surface of the main flange portion 131 in the radial direction. The outer circumferential surface of the frame fixing portion 136 may be fixed in close contact with the inner circumferential surface of the casing 110. Accordingly, the frame 130 may be fixedly coupled to the casing 110.

The main bearing portion 132 may protrude downward from a lower surface of a central part or portion of the main flange portion 131 toward the drive motor 120. A bearing hole 132*a* formed in a cylindrical shape may penetrate through the main bearing portion 132 in the axial direction. Accordingly, the rotary shaft 125 may be inserted into an inner circumferential surface of the bearing hole 132*a* and supported in the radial direction.

The orbiting space portion 133 may be recessed from the center part of the main flange portion 131 toward the main bearing portion 132 to have a predetermined depth and outer diameter. The outer diameter of the orbiting space portion 133 may be larger than an outer diameter of a rotary shaft coupling portion 143 that is disposed on the orbiting scroll 140 discussed hereinafter. Accordingly, the rotary shaft coupling portion 143 may be pivotally accommodated in the orbiting space portion 133.

The scroll support portion 134 may be formed in an annular shape on an upper surface of the main flange portion 131 along a circumference of the orbiting space portion 133. Accordingly, the scroll support portion 134 may support the lower surface of an orbiting end plate 141 discussed hereinafter in the axial direction.

The Oldham ring support portion 135 may be formed in an annular shape on an upper surface of the main flange portion 131 along an outer circumferential surface of the scroll support portion 134. Accordingly, an Oldham ring 170 may be inserted into the Oldham ring supporting portion 135 to be pivotable.

The frame fixing portion 136 may extend radially from an outer circumference of the Oldham ring support portion 135. The frame fixing portion 136 may extend in an annular shape or extend to form a plurality of protrusions spaced apart from one another by preset or predetermined distances. This embodiment illustrates an example in which the frame fixing portion 136 has a plurality of protrusions along the circumferential direction.

Referring to FIG. 1, the orbiting scroll 140 according to this embodiment is coupled to the rotary shaft 125 to be disposed between the main frame 130 and the non-orbiting scroll 150. An Oldham ring 170, which is an anti-rotation mechanism, may be disposed between the main frame 130 and the orbiting scroll 140. Accordingly, the orbiting scroll 140 may perform an orbiting motion relative to the non-orbiting scroll 150 while its rotational motion is restricted.

The orbiting scroll 140 may include an orbiting end plate 141, an orbiting wrap 142, and the rotary shaft coupling portion 143. The orbiting end plate 141 may be formed approximately in a disk shape. An outer diameter of the orbiting end plate 141 may be mounted on the scroll support portion 134 of the main frame 130 to be supported in the axial direction. Accordingly, the orbiting end plate 141 and the scroll support portion 134 facing it defines an axial bearing surface (no reference numeral given).

The orbiting wrap 142 may be formed in a spiral shape by protruding from an upper surface of the orbiting end plate 141 facing the non-orbiting scroll 150 to a preset or predetermined height. The orbiting wrap 142 may be formed to correspond to the non-orbiting wrap 152 to perform an orbiting motion by being engaged with a non-orbiting wrap 152 of the non-orbiting scroll 150 discussed hereinafter. The orbiting wrap 142 defines compression chambers V together with the non-orbiting wrap 152.

The compression chambers V include a first compression chamber V1 and a second compression chamber V2 based on the orbiting wrap 142. Each of the first compression chamber V1 and the second compression chamber V2 includes a suction pressure chamber (not illustrated), an intermediate pressure chamber (not illustrated), and a discharge pressure chamber (not illustrated) that are continuously formed. Hereinafter, description will be given under assumption that a compression chamber defined between an outer surface of the orbiting wrap 142 and an inner surface of the non-orbiting wrap 152 facing the same is defined as the first compression chamber V1, and a compression chamber defined between an inner surface of the orbiting wrap 142 and an outer surface of the non-orbiting wrap 152 facing the same is defined as the second compression chamber V2.

The rotary shaft coupling portion 143 may protrude from a lower surface of the orbiting end plate 141 toward the main frame 130. The rotary shaft coupling portion 143 may be formed in a cylindrical shape, so that an orbiting bearing (not illustrated) configured as a bush bearing may be press-fitted to its inner circumferential surface.

Referring to FIG. 1, the non-orbiting scroll 150 according to this embodiment is disposed on an upper portion of the main frame 130 with the orbiting scroll 140 interposed therebetween. The non-orbiting scroll 150 may be fixedly coupled to the main frame 130 or may be coupled to the main frame 130 to be movable up and down. This embodiment illustrates an example in which the non-orbiting scroll 150 is coupled to the main frame 130 to be movable relative to the main frame 130 in the axial direction.

More specifically, the non-orbiting scroll 150 according to this embodiment includes a non-orbiting end plate 151, a non-orbiting wrap 152, a non-orbiting side wall portion 153, and a guide protrusion 154. The non-orbiting end plate portion 151 is formed in a disk shape and disposed in a lateral direction in the low-pressure part 110*a* of the casing 110. A discharge port 1511, a bypass hole 1512, a first variable-capacity hole 1811*a*, and a scroll-side second variable-capacity hole 1821*a*1 may be formed in the non-rotating end plate portion 151.

The discharge port 1511 is a passage through which compressed refrigerant may be discharged from a final compression chamber to the high-pressure part 110*b*. The discharge port 1511 may be provided as one port through which discharge pressure chambers (no reference numerals given) of both compression chambers V1 and V2 formed at inner and outer sides of the non-orbiting wrap 152 communicate with each other. However, in some cases, the discharge port 1511 may be provided as a plurality to communicate with the compression chambers V1 and V2 independently. This embodiment illustrates an example in which one discharge port 1511 is formed.

The bypass hole 1512 is a type of overcompression suppressing portion that is formed at the suction side rather than the discharge port 1511 such that some of compressed refrigerant is discharged to the high-pressure part 110*b* in advance. The bypass hole 1512 may be formed to communicate with each compression chamber V1, V2 independently. One bypass holes 1512 may be formed in the respective compression chambers V2. However, in some cases, the bypass hole 1512 may be provided as a plurality formed at preset or predetermined distances along a formation direction of each compression chamber V1 and V2.

The first variable-capacity hole 1811*a* and the scroll-side second variable-capacity hole 1821*a*1 may be formed at positions spaced apart from the discharge port 1511 and the bypass hole 1512. In other words, the first variable-capacity hole 1811*a* and the scroll-side second variable-capacity hole 1821*a*1 define a first variable-capacity unit 181 and a second variable-capacity unit 182, which will be discussed hereinafter, respectively, such that the compression chamber V and the low-pressure part 110*a* are connected to each other therethrough. The first variable-capacity hole 1811*a* and the scroll-side second variable-capacity hole 1821*a*1 may be formed at the suction side rather than the bypass hole 1512. The first variable-capacity hole 1811*a* may be formed at the suction side compared to the scroll-side second variable-capacity hole 1821*a*1. Accordingly, the discharge port 1511, the first bypass hole 1512, the scroll-side second variable-capacity hole 1821*a*1, and the first variable-capacity hole

1811*a* may be sequentially formed in the non-orbiting end plate 151 from a discharge side to a suction side. This will be discussed hereinafter along with the first variable-capacity unit 181 and the second variable-capacity unit 182.

The non-orbiting wrap 152 may extend from a lower surface of the non-orbiting end plate 151 facing the orbiting scroll 140 by a preset or predetermined height in the axial direction. The non-orbiting wrap 152 may extend to be spirally rolled a plurality of times toward the non-orbiting side wall portion 153 in the vicinity of the discharge port 1511. The non-orbiting wrap 152 may be formed to correspond to the orbiting wrap 142, so as to define the pair of compression chambers V with the orbiting wrap 142.

The non-orbiting side wall portion 153 may extend in an annular shape from a rim of a lower surface of the non-orbiting end plate 151 in the axial direction to surround the non-orbiting wrap 152. A suction port 1531 may be formed through one side of an outer circumferential surface of the non-orbiting side wall portion 153 in the radial direction.

The guide protrusion 154 may extend radially from an outer circumferential surface of a lower side of the non-orbiting side wall portion 153. The guide protrusion 154 may be formed as a single annular shape or may be provided as a plurality disposed at preset or predetermined distances in the circumferential direction. This embodiment will be mainly described based on an example in which the plurality of guide protrusions 154 are disposed at preset or predetermined distances along the circumferential direction.

Referring to FIG. 1, the back pressure chamber assembly 160 according to this embodiment may be disposed at an upper side of the non-orbiting scroll 150. Accordingly, a back pressure of a back pressure chamber 160*a* (more specifically, a force of the back pressure acting on the back pressure chamber) is applied to the non-orbiting scroll 150. In other words, the non-orbiting scroll 150 is pressed toward the orbiting scroll 140 by the back pressure to seal the compression chambers V1 and V2.

The back pressure chamber assembly 160 may include a back pressure plate 161 and a floating plate 165. The back pressure plate 161 may be coupled to an upper surface of the non-orbiting end plate 151. The floating plate 165 may be slidably coupled to the back pressure plate 161 to define the back pressure chamber 160*a* together with the back pressure plate 161.

The back pressure plate 161 may include a fixed plate portion 1611, a first annular wall portion 1612, and a second annular wall portion 1613. A plate-side back pressure hole 1611*a* may be formed through the fixed plate portion 1611 in the axial direction. The plate-side back pressure hole 1611*a* may be formed on a same axis as a back pressure communication hole 180*d* formed in the variable-capacity plate 180 and a scroll-side back pressure hole 1513 formed in the non-orbiting scroll 150, which will be discussed hereinafter. Accordingly, an intermediate pressure chamber Vm and the back pressure chamber 160*a* may communicate with each other through the scroll-side back pressure hole 1513, the back pressure communication hole 180*d*, and the plate-side back pressure hole 1611*a*.

The first annular wall portion 1612 and the second annular wall portion 1613 may be formed on an upper surface of the fixed plate portion 1611 to surround inner and outer circumferential surfaces of the fixed plate portion 1611. Accordingly, the back pressure chamber 160*a* formed in the annular shape may be defined by an outer circumferential surface of the first annular wall portion 1612, an inner circumferential surface of the second annular wall portion 1613, the upper surface of the fixed plate portion 1611, and a lower surface of the floating plate 165.

The first annular wall portion 1612 may include an intermediate discharge port 1612*a* that communicates with the discharge port 1511 of the non-orbiting scroll 150. A valve guide groove 1612*b* into which a discharge valve 155 may be slidably inserted may be formed at an inner side of the intermediate discharge port 1612*a*. A backflow prevention hole 1612*c* may be formed at a center of the valve guide groove 1612*b*. Accordingly, the discharge valve 155 may selectively provide communication between the discharge port 1511 and the intermediate discharge port 1612*a* to suppress or prevent discharged refrigerant from flowing back into the compression chambers V1 and V2.

The floating plate 165 may be formed in an annular shape. The floating plate 165 may be formed of a lighter material than the back pressure plate 161. Accordingly, the floating plate 165 may be detachably coupled to a lower surface of the high/low pressure separation plate 115 while moving in the axial direction with respect to the back pressure plate 161 depending on a pressure of the back pressure chamber 160*a*. For example, when the floating plate 165 is brought into contact with the high/low pressure separation plate 115, the floating plate 165 serves to seal the low-pressure part 110*a* such that discharged refrigerant is discharged to the high-pressure part 110*b* without leaking into the low-pressure part 110*a*.

Referring to FIGS. 1 and 2, the variable-capacity plate 180 according to an embodiment may be disposed between the non-orbiting scroll 150 and the back pressure chamber assembly 160 and a portion of the first variable-capacity unit 181 discussed hereinafter and a portion of the second variable-capacity unit 182 discussed hereinafter may be disposed on the variable-capacity plate 180. For example, at least one of a first variable-capacity valve 1812 or a second variable-capacity valve 1822, which will be discussed hereinafter, may be mounted on the variable-capacity plate 180. Accordingly, a bypass valve (no reference numeral given), for example, may be mounted on a rear surface of the non-orbiting scroll 150 (more specifically, the non-orbiting end plate 151) facing the back pressure chamber assembly 160, and thus, a plurality of variable-capacity units 181 and 182 that communicates with different intermediate pressure chambers Vm may be formed even if a space is insufficient for mounting the variable-capacity valves 1812 and 1822 in the non-orbiting scroll 150. This may allow an operating area or an operating step of the scroll compressor to be controlled through multiple stages, which may lower a variable-capacity ratio and increase energy efficiency. In this embodiment, description will focus on an example in which the first variable-capacity valve 1812 is mounted on the non-orbiting scroll 150 and the second variable-capacity valve 1822 is mounted on the variable-capacity plate 180.

More specifically, the variable-capacity plate 180 may be formed in a substantially annular shape, and may be formed similarly to the shape of a rear surface of the non-orbiting scroll 150 and/or a rear surface of the back pressure chamber assembly 160. In other words, the variable-capacity plate 180 may be formed in an annular shape with a valve receiving hole 180*a* formed in its center. The valve receiving hole 180*a* may be formed to communicate with an intermediate discharge port 1612*a* of the back pressure chamber assembly 160. Accordingly, the discharge port 1511 and the bypass hole 1512 may be received inside of the valve receiving hole 180*a* and communicate with the intermediate discharge port 1612*a* through the valve receiving hole 180*a*.

In addition, the variable-capacity plate 180 may include a first valve receiving groove 1811*b* formed in a first side surface 180*b* of the variable-capacity plate 180 facing the rear surface of the non-orbiting scroll 150 to receive therein the first variable-capacity valve 1812 discussed hereinafter, and a second valve receiving groove 1821*b* formed in a second side surface 180*c* of the variable-capacity plate 180 facing the rear surface of the back pressure chamber assembly 160 to receive therein the second variable-capacity valve 1822 discussed hereinafter. The first valve receiving groove 1811*b* may be recessed by a preset or predetermined depth from the first side surface 180*b* toward the second side surface 180*c* of the variable-capacity plate 180. For example, the first valve receiving groove 1811*b* may be formed in an arcuate shape like U, and the first variable-capacity valves 1812, which will be discussed hereinafter, may be received in both ends of the first valve receiving groove 1811*b*, respectively. In other words, the non-orbiting scroll 150 may include a plurality of the first variable-capacity hole 1811*a*, independently communicating with the first compression chamber V1 and the second compression chamber V2 with a phase difference of approximately 180°. The first valve receiving groove 1811*b* may receive the plurality of first variable-capacity holes 1811*a* such that the plurality of first variable-capacity holes 1811*a* communicate with each other. Accordingly, the plurality of first variable-capacity holes 1811*a* may be formed independently of each other in the single first valve receiving groove 1811*b* and communicate with each other depending on an opening and closing operation of each first variable-capacity valve 1812.

In addition, a first exhaust hole 1811*c* may be formed in a middle portion of the first valve receiving groove 1811*b* to penetrate through an outer circumferential surface of the first valve receiving groove 1811*b*. A variable-capacity opening and closing valve 1813 discussed hereinafter may be mounted on an outer circumferential surface of one side of the variable-capacity plate 180 to open and close the first exhaust hole 1811*c*. Accordingly, the first variable-capacity valves 1812 may be opened and closed in conjunction with the opening and closing operation of the first variable-capacity opening and closing valve 1813. This will be discussed again hereinafter together with the first variable-capacity unit 181.

The second valve receiving groove 1821*b* may be recessed by a preset or predetermined depth from the second side surface 180*c* toward the first side surface 180*b* of the variable-capacity plate 180. For example, the second valve receiving groove 1821*b* may be formed in an arcuate shape like U, and second variable-capacity valves 1822, which will be discussed hereinafter, may be received in both ends of the second valve receiving groove 1821*b*, respectively. In other words, the non-orbiting scroll 150 may have a plurality of the scroll-side second variable-capacity hole 1821*a*1 formed with a phase difference of approximately 180° to independently communicate with the first compression chamber V1 and the second compression chamber V2. The variable-capacity plate 180 may have plate-side second variable-capacity holes 1821*a*2 formed to communicate with the plurality of scroll-side second variable-capacity holes 1821*a*1. The second valve receiving groove 1821*b* may receive each of the plurality of plate-side second variable-capacity holes 1821*a*2 such that the plurality of plate-side second variable-capacity holes 1821*a*2 communicate with each other. Accordingly, the plurality of plate-side variable-capacity 1821*a*2 may be formed independently of each other in the single second valve receiving groove 1821*b* and communicate with each other depending on an opening and closing operation of each second variable-capacity valve 1822.

Additionally, the second valve receiving groove 1821*b* may be formed to overlap the first valve receiving groove 1811*b* when projected in the axial direction. In other words, the second valve receiving groove 1821*b* may be formed not to interfere with the first valve receiving groove 1811*b* in the axial direction but both the valve receiving grooves 1811*b* and 1821*b* may overlap each other when projected in the axial direction. Accordingly, the plurality of variable-capacity units 181 and 182 may be formed to communicate with different intermediate pressure chambers Vm1 and Vm2 without enlarging a diameter of the non-orbiting scroll 150.

In addition, a second exhaust hole 1821*c* may be formed in a middle portion of the second valve receiving groove 1821*b* to penetrate through an outer circumferential surface of the second valve receiving groove 1811*b*. A second variable-capacity opening/closing valve 1823 discussed hereinafter may be mounted on an outer circumferential surface of the second side of the variable-capacity plate 180 to open and close the second exhaust hole 1821*c*. Accordingly, the second variable-capacity valves 1822 may be opened and closed in conjunction with the opening and closing operation of the second variable-capacity opening and closing valve 1823. This will be discussed hereinafter together with the second variable-capacity unit 182.

The scroll compressor according to this embodiment may operate as follows.

That is, when power is applied to the drive motor 120 and a rotational force is generated, the orbiting scroll 170 eccentrically coupled to the rotary shaft 125 performs an orbiting motion relative to the non-orbiting scroll 150 due to the Oldham ring 180. During this process, first compression chamber V1 and second compression chamber V2 that continuously move are formed between the orbiting scroll 140 and the non-orbiting scroll 140. Then, the first compression chamber V1 and the second compression chamber V2 are gradually reduced in volume as they move from the suction port 1531 (or suction pressure chamber) to the discharge port 1511 (or discharge pressure chamber) during the orbiting motion of the orbiting scroll 140.

Accordingly, refrigerant is suctioned into the low-pressure part 110*a* of the casing 110 through the refrigerant suction pipe 117. Some of this refrigerant is suctioned directly into the suction pressure chambers (no reference numerals given) of the first compression chamber V1 and the second compression chamber V2, respectively, while the remaining refrigerant first flows toward the drive motor 120 to cool down the drive motor 120 and then is suctioned into the suction pressure chambers (no reference numerals given).

The refrigerant is compressed while moving along moving paths of the first compression chamber V1 and the second compression chamber V2. The compressed refrigerant partially flows into the back pressure chamber 160*a* formed by the back pressure plate 161 and the floating plate 165 through a back pressure inflow passage forming an inlet-side back pressure passage and a back pressure outflow passage forming an outlet-side back pressure passage before reaching the discharge port 1511. Accordingly, the back pressure chamber 160*a* forms an intermediate pressure.

The floating plate 165 then rises toward the high/low pressure separation plate 115 to be brought into close contact with the high/low pressure separation plate 115. The high-pressure part 110*b* of the casing 110 is separated from the low-pressure part 110*a*, to prevent the refrigerant discharged from each compression chamber V1 and V2 from flowing back into the low-pressure part 110*a*.

On the other hand, the back pressure plate 161 is pressed down toward the non-orbiting scroll 150 by the pressure of the back pressure chamber 160*a*. The non-orbiting scroll 150 is pressed toward the orbiting scroll 140. Accordingly, the non-orbiting scroll 150 may be brought into close contact with the orbiting scroll 140, thereby preventing the refrigerant inside of both compression chambers from leaking from a high-pressure compression chamber forming an intermediate pressure chamber to a low-pressure compression chamber.

The refrigerant is compressed to a set or predetermined pressure while moving from the intermediate pressure chamber toward a discharge pressure chamber. This refrigerant moves to the discharge port 1511 and presses the discharge valve 155 in an opening direction. Responsive to this, the discharge valve 155 is pushed up along the valve guide groove 1612*b* by the pressure of the discharge pressure chamber, so as to open the discharge port 1511. Then, the refrigerant in the discharge pressure chamber flows to the high-pressure part 110*b* through the discharge port 1511 and the intermediate discharge port 1612*a* disposed in the back pressure plate 161.

A scroll compressor according to embodiments may be provided with a plurality of variable-capacity units communicating with different intermediate pressure chambers, so that energy efficiency may be increased by differently varying a compression capacity while the compressor operates at a constant speed. In this embodiment, the scroll compressor is explained focusing on an example including the first variable-capacity unit 181 and the second variable-capacity unit 182, but, if necessary, a variable-capacity unit such as a third variable-capacity unit may be added in the same manner.

Figure 3:
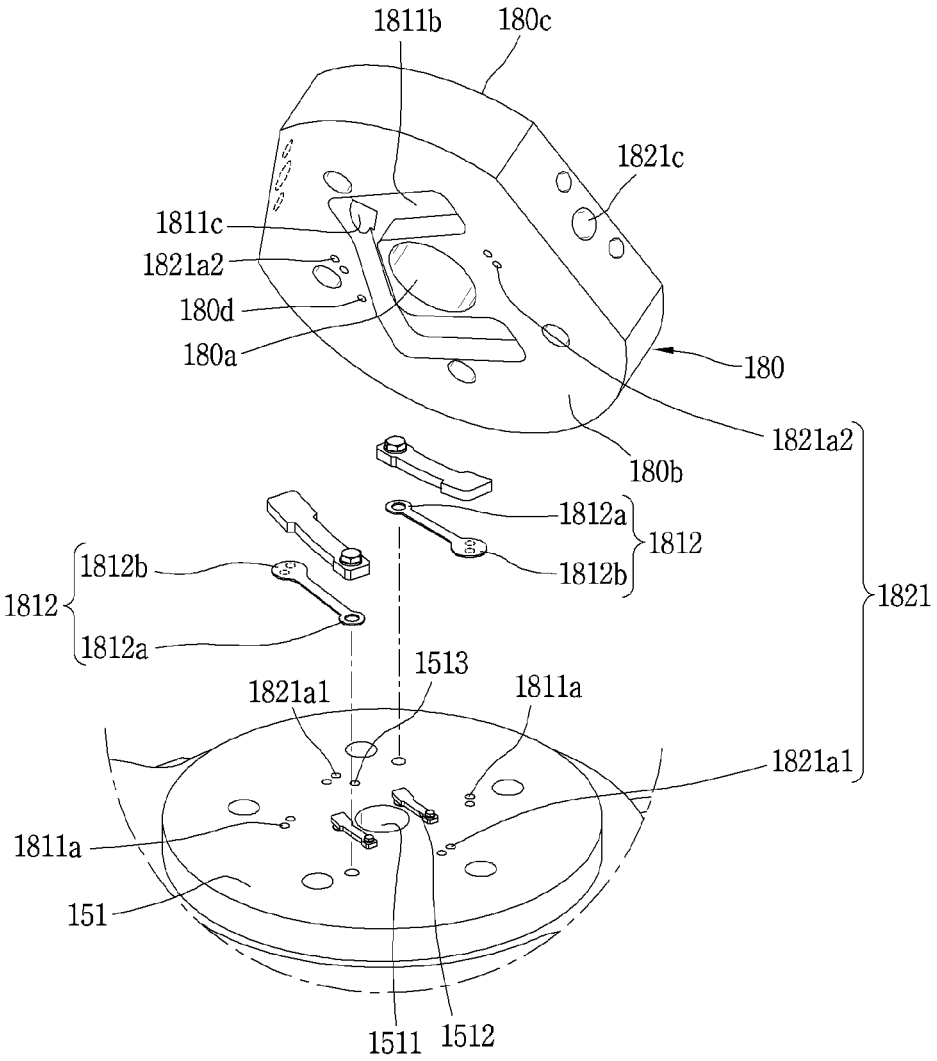
FIG. 3 is an exploded perspective view of a portion of a first variable-capacity unit in FIG. 2.
Figure 4:
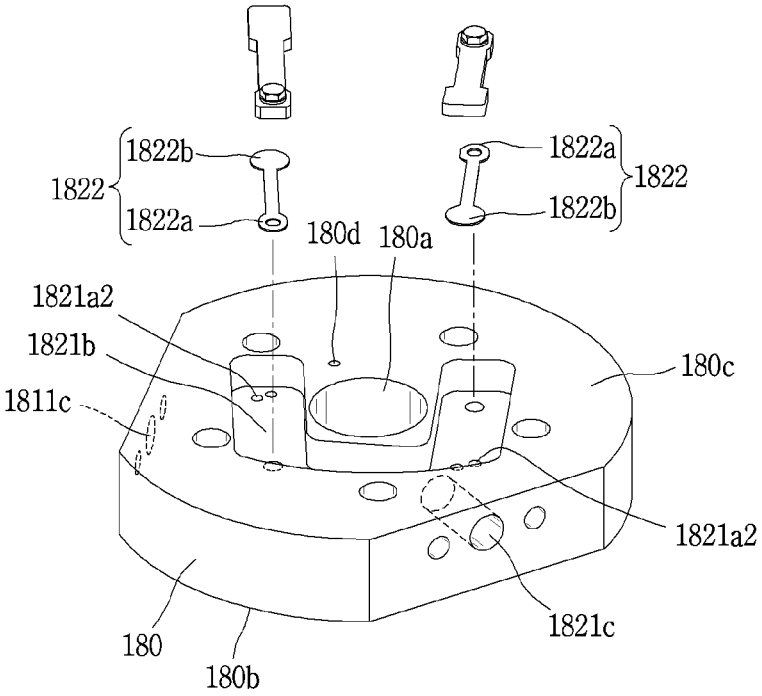
FIG. 4 is an exploded perspective view of a portion of a second variable-capacity unit in FIG. 2.
Figure 5:
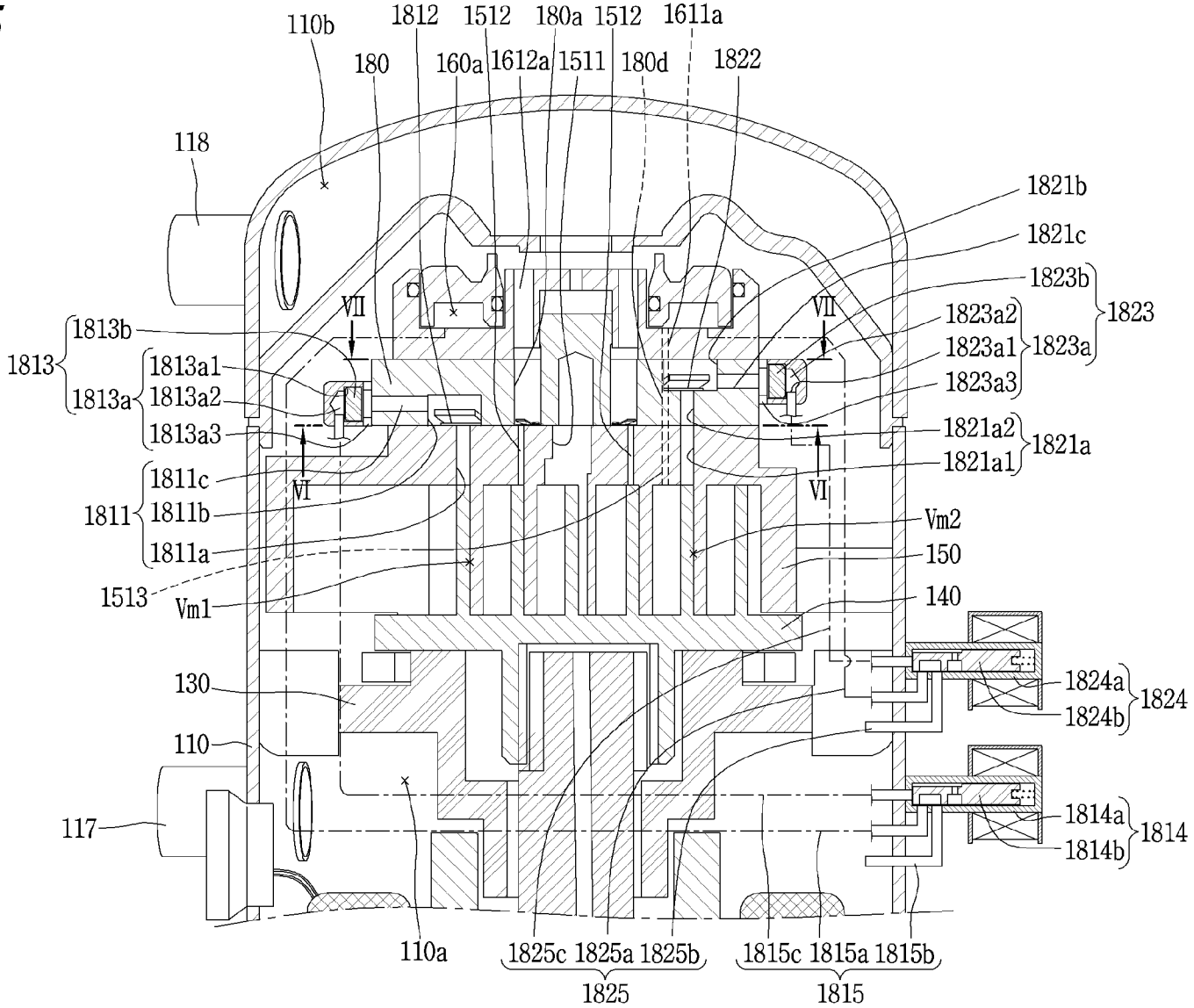
FIG. 5 is an enlarged longitudinal cross-sectional view of a portion of the scroll compressor of FIG. 1.
Figure 6:
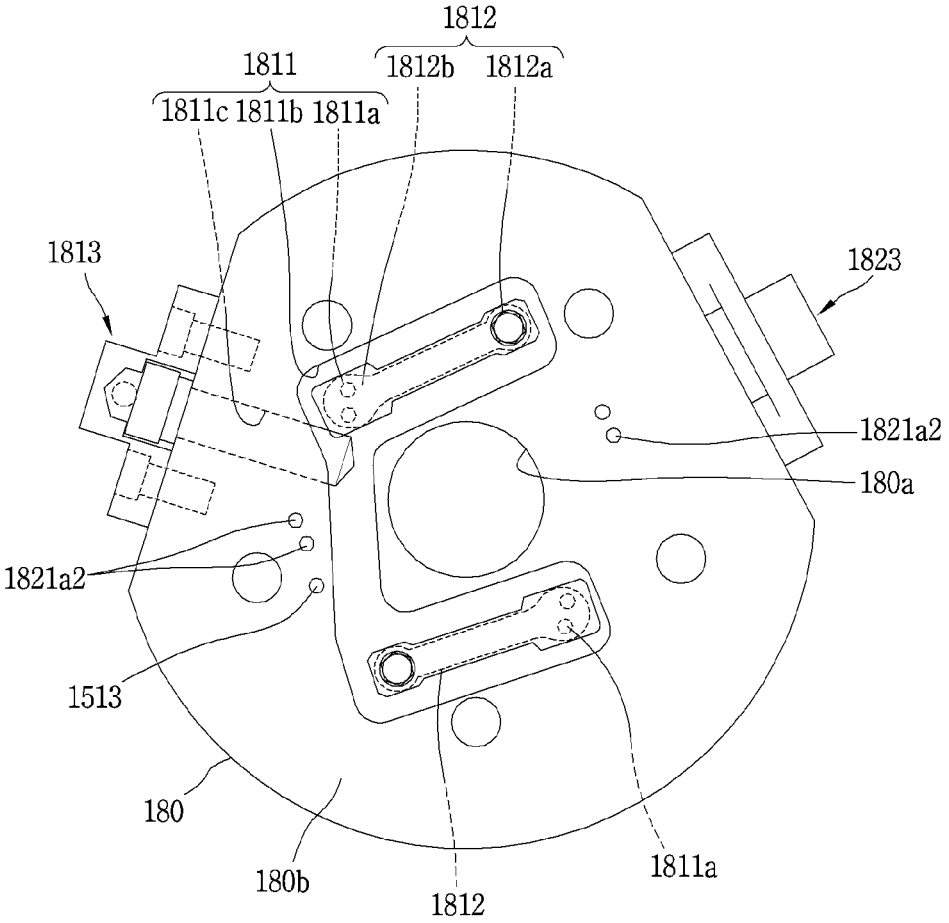
FIG. 6 is a cross-sectional view, taken along line "VI-VI" of FIG. 5.
Figure 7:
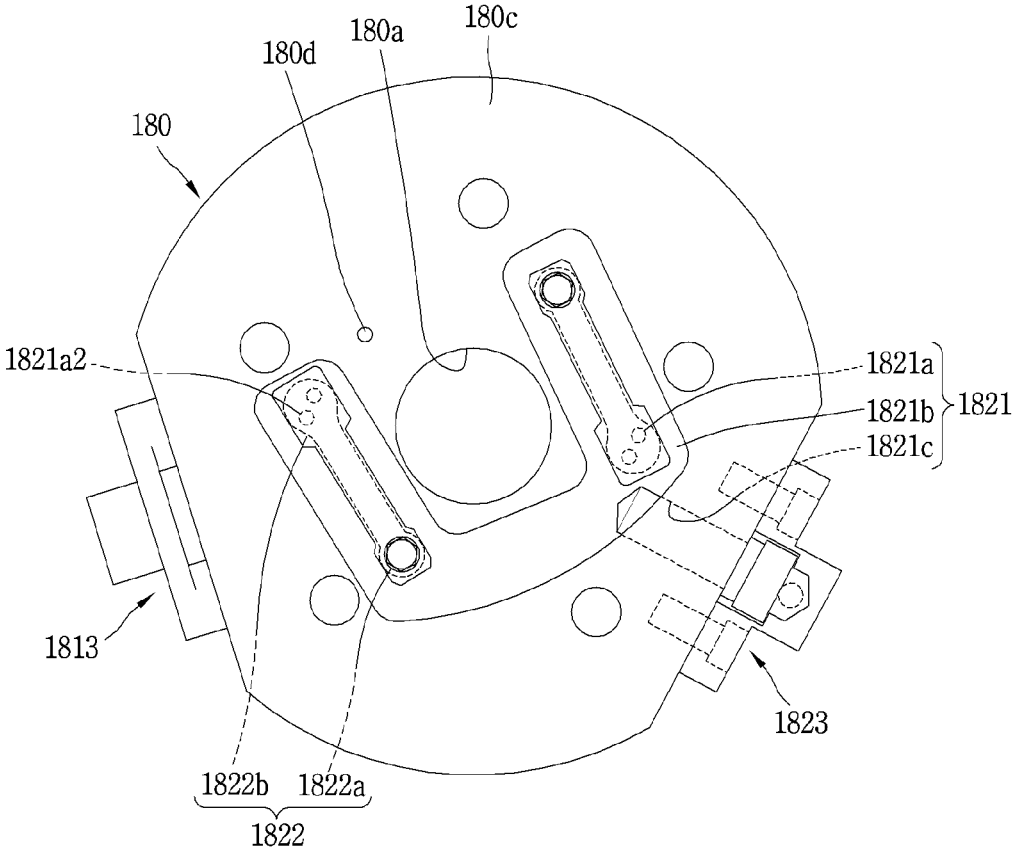
FIG. 7 is a cross-sectional view, taken along line "VII-VII" of FIG. 5.

FIG. 3 is an exploded perspective view of a portion of a first variable-capacity unit in FIG. 2. FIG. 4 is an exploded perspective view of a portion of a second variable-capacity unit in FIG. 2, FIG. 5 is an enlarged longitudinal cross-sectional view of a portion of the scroll compressor of FIG. 1. FIG. 6 is a cross-sectional view, taken along line "VI-VI" of FIG. 5, and FIG. 7 is a cross-sectional view, taken along line "VII-VII" of FIG. 5.

Referring to FIGS. 3 and 5, the first variable-capacity unit 181 according to an embodiment may include first variable-capacity passage 1811, first variable-capacity valve 1812, first variable-capacity opening and closing valve 1813, and first variable-capacity control valve 1814. In other words, the first variable-capacity unit 181 may vary the capacity of the compression chamber V by selectively bypassing refrigerant in a first intermediate pressure chamber Vm1, which has a first pressure lower than a pressure of the second intermediate pressure chamber Vm2, which will be discussed hereinafter.

The first variable-capacity passage 1811 may include first variable-capacity hole 1811*a*, first valve receiving groove 1811*b*, and first exhaust hole 1811*c*. The first variable-capacity hole 1811*a* is a bypass passage along which refrigerant of the first intermediate pressure is bypassed, and the first valve receiving groove 1811*b* is a space in which the first variable-capacity valve 1812 discussed hereinafter is received. The first exhaust hole 1811*c* is an exhaust passage along which the refrigerant bypassed through the first variable-capacity hole 1811*a* is guided to the low-pressure part 110*a* (suction space) of the casing 110.

The first variable-capacity hole 1811*a*, as aforementioned, may be formed through the non-orbiting scroll 150 in a manner that a first end thereof penetrates toward the first intermediate pressure chamber Vm1 and a second end penetrates through the rear surface of the non-orbiting scroll 150. The first variable-capacity hole 1811*a* may be formed through the non-orbiting scroll 150, but in some cases, may be formed to be inclined in the axial direction. Accordingly, depending on whether the first variable-capacity valve 1812, which will be discussed hereinafter, is open or closed, some of the refrigerant in the first intermediate pressure chamber Vm1 may be bypassed through the first variable-capacity hole 1811*a*.

In addition, the first variable-capacity hole 1811*a* may be provided as a plurality to communicate with the first compression chamber V1 and the second compression chamber V2, respectively, and disposed at both sides of the discharge port 1511 with a phase difference of approximately 180°. However, in some cases, the plurality of first variable-capacity holes 1811*a* may be formed between non-orbiting wraps 152 facing each other, namely, at one side of the discharge port 1511 with a phase difference of approximately 360°. This embodiment illustrates an example in which the plurality of first variable-capacity holes 1811*a* is formed at both sides of the discharge port 1511 with a phase difference of approximately 180°.

Referring to FIGS. 3 and 6, the first valve receiving groove 1811*b*, as discussed above, may be formed to be recessed by a preset or predetermined depth from the first side surface 180*b* of the variable-capacity plate 180 facing the rear surface of the non-orbiting scroll 150 toward the second side surface 180*c* as the opposite side surface. For example, a depth of the first valve receiving groove 1811*b* may be less than a half of a thickness of the variable-capacity plate 180. Accordingly, the first valve receiving groove 1811*b* may be suppressed or prevented from interfering axially with the second valve receiving groove 1821*b*, which will be discussed hereinafter, such that positions of the first variable-capacity passage 1811 and the second variable-capacity passage 1821 may be freely set.

Additionally, the first valve receiving groove 1811*b* may be formed in an arcuate shape to accommodate the plurality of first variable-capacity holes 1811*a*. For example, the first valve receiving groove 1811*b* may be formed in the U-like shape as described above, and one first variable-capacity hole 1811*a* may communicate with each end of the first valve receiving groove 1811*b*. Accordingly, the plurality of first variable-capacity holes 1811*a* may communicate with each other in the single first valve receiving groove 1811*b*.

Referring to FIGS. 3 and 5, the first exhaust hole 1811*c* may be formed to penetrate between an outer surface of the first valve receiving groove 1811*b* and the outer circumferential surface of the variable-capacity plate 180, as described above. In other words, the first exhaust hole 1811*c* may be a hole formed through the inside of the variable-capacity plate 180. However, in some cases, the first exhaust hole 1811*c* may alternatively be formed as a groove recessed by a preset or predetermined depth into the first side surface 180*b* of the variable-capacity plate 180. However, in this embodiment, for convenience, it is collectively referred to as the first exhaust hole 1811*c*.

Additionally, the first exhaust hole 1811*c* may be formed to communicate with the first variable-capacity holes 1811*a* in the middle of the first valve receiving groove 1811*b*. However, in some cases, the first exhaust hole 1811*c* may be formed to independently communicate with the plurality of first variable-capacity holes 1811*a*. This embodiment illustrates an example in which one first exhaust hole 1811*c* is formed in the middle of the first valve receiving groove

1811*b*. This may suppress or prevent an increase in the number of first variable-capacity opening and closing valves 1813 discussed hereinafter while facilitating machining of the first exhaust hole 1811*c*.

Referring to FIGS. 2 and 5, the first variable-capacity valve 1812 may include a first fixed portion 1812*a* and a first opening and closing portion 1812*b*. In other words, the first variable-capacity valve 1812 may be configured as a cantilever-shaped reed valve, and may be configured as a plurality of reed valves each having the first fixed portion 1812*a* and the first opening and closing portion 1812*b* to correspond to the plurality of first variable-capacity holes 1811*a*. However, in some cases, a plurality of first opening and closing portions 1812*b* may be divided (may extend) from one first fixed portion 1812*a*. This embodiment illustrates an example in which the first variable-capacity valve is configured as a plurality of reed valves each having the first fixed portion 1812*a* and the first opening and closing portion 1812*b* separated from each other. Accordingly, the behavior of the first variable-capacity valve 1812 may be stabilized.

The first fixed portions 1812*a* may be, for example, bolted to the rear surface of the non-orbiting scroll 150, and the first opening and closing portions 1812*b* may extend from the first fixing portions 1812*a* and form free ends to open and close the first variable-capacity holes 1811*a*. Accordingly, the first opening and closing portion 1812*b* may open and close the first variable-capacity hole 1811*a* by rotating around the first fixed portion 1812*a*.

Additionally, the first variable-capacity valves 1812 may be disposed to be inversely symmetrical to each other with respect to an axial center of the rotary shaft 125. For example, the first fixed portion 1822*a* of the first variable-capacity valve 1812 that opens and closes the first compression chamber V1 may be disposed in a diagonal direction with respect to the first fixed portion 1812*a* of the first variable-capacity valve that opens and closes the second compression chamber V2, while the second opening and closing portion 1822*b* of the first variable-capacity valve 1812 that opens and closes the first compression chamber V1 may be disposed in the diagonal direction with respect to the first opening and closing portion 1812*b* of the first variable-capacity valve 1812 that opens and closes the second compression chamber V2. This may secure a circumferential distance between the first variable-capacity valves 1812 and minimize valve lengths of both the first variable-capacity valves 1812. Through this, interference between the first variable-capacity valves 1812 may be suppressed or prevented while an assembly of the first variable-capacity valves 1812 and 1812 may be improved.

Also, the first variable-capacity valves 1812 may be received in both ends of the first valve receiving groove 1811*b*. In this case, a separate retainer (no reference numeral given) may be disposed at a the rear surface of each first variable-capacity valve 1812 to be received in the first valve receiving groove 1811*b* together with the first variable-capacity valve 1812. In some cases, a retainer portion may alternatively be formed in the first valve receiving groove 1811*b*. This embodiment illustrates an example in which separate retainers are disposed in the first variable-capacity valves 1812, respectively.

Referring to FIGS. 2 and 5, the first variable-capacity opening and closing valve 1813 may be a type of check valve that provides communication between the first intermediate pressure chamber Vm1 and the low-pressure part (suction space) together with the first variable-capacity valve 1812. As such, the first variable-capacity opening and closing valve 1813 may be disposed at a downstream side of the first variable-capacity valve 1812 based on a bypass path of refrigerant. Accordingly, a pressure of a back pressure side of the first variable-capacity valve 1812 may be determined by the first variable-capacity opening and closing valve 1813, and thus, opening and closing of the first variable-capacity valve 1812 may be determined.

The first variable-capacity opening and closing valve 1813 may alternatively be configured as a piston valve, or may be configured as various types of valves, such as a plate valve or a ball valve. In this embodiment, an example in which the first variable-capacity opening and closing valve 1813 is a piston valve is illustrated.

For example, the first variable-capacity opening and closing valve 1813 according to this embodiment may include a first opening and closing valve housing 1813*a* and a first opening and closing valve member 1813*b*. The first opening and closing valve housing 1813*a* may be fastened to the outer circumferential surface of the variable-capacity plate 180, and the first opening and closing valve member 1813*b* may be slidably inserted into the first opening and closing valve housing 1813*a*. Accordingly, the first opening and closing valve member 1813*b* may open and close the first exhaust hole 1811*c* while reciprocating in the first opening and closing valve housing 1813*a* according to a pressure difference between an opening and closing surface and a back pressure surface.

A first valve space 1813*a*1 may extend radially inside of the first opening and closing valve housing 1813*a*, and a first differential pressure space 1813*a*2 may extend at the outside of the first valve space 1813*a*1 to provide operation pressure to the back pressure surface of the first opening and closing valve member 1813*b*, which is inserted into the first valve space 1813*a*1. First exhaust through-holes 1813*a*3 that communicate with the first exhaust hole 1811*c* may be formed in both upper and lower sides of the first valve space 1813*a*1. Accordingly, when the first opening and closing valve member 1813*b* is pushed rearward and the first exhaust hole 1811*c* is opened, refrigerant discharged through the first exhaust hole 1811*c* may flow into the low-pressure part 110*a* (suction space) of the casing 110 through the first exhaust through-holes 1813*a*3.

A first back pressure connection tube 1815*c*, which will be discussed hereinafter, may be connected to the first differential pressure space 1813*a*2. Accordingly, the first differential pressure space 1813*a*2 may be connected to the first variable-capacity control valve 1814, which will be discussed hereinafter, through the first back pressure connection tube 1815*c*. Through this, refrigerant of an intermediate pressure or a suction pressure supplied to the first back pressure connection tube 1815*c* may be supplied to the first differential pressure space 1813*a*2 to open and close the first opening and closing valve member 1813*b* of the first variable-capacity opening and closing valve 1813.

Referring to FIGS. 2 and 5, the first variable-capacity control valve 1814 is a type of solenoid valve that provides the back pressure to the first variable-capacity opening and closing valve 1813, and may be disposed on the outside of the casing 110 to be connected to the first variable-capacity opening and closing valve 1813 through a first control valve connecting portion 1815.

For example, the first variable-capacity control valve 1814 according to this embodiment may include a first control valve housing 1814*a* and a first control valve member 1814*b*. The first control valve housing 1814*a* may be fastened to an outer circumferential surface of one side of the casing 110, and the first control valve member 1814*b* may be slidably inserted into the first control valve housing

1814*a*. Accordingly, depending on whether external power is input or not, the first control valve member 1814*b* selectively supplies refrigerant of the intermediate pressure or the suction pressure to refrigerant toward the first variable-capacity opening and closing valve 1813 while reciprocating in the first control valve housing 1814*a*. Through this, the first variable-capacity opening and closing valve 1813 may be operated by a difference in the back pressure provided by the first variable-capacity control valve 1814.

The first control valve housing 1814*a* may be fixedly coupled to the outer circumferential surface of the casing 110 using a bracket (no reference numeral given). However, in some cases, the first control valve housing 1814*a* may be directly welded on the casing 110 without using a separate bracket.

The first control valve member 1814*b* may be provided with a drive unit (no reference numeral given) to which an external power source is connected. Depending on whether or not external power is supplied to the drive unit, a valve unit (no reference numeral given) of the first control valve member 1814*b* may control a connecting direction of the first control valve connecting portion 1815 discussed hereinafter while reciprocating in the first control valve housing 1814*a*.

The first variable-capacity control valve 1814 may be connected to the first variable-capacity opening and closing valve 1813 through the first control valve connecting portion 1815, as described above. Accordingly, the first variable-capacity control valve 1814 may control the opening and closing operation of the first variable-capacity opening and closing valve 1813 using pressure of refrigerant transmitted through the first control valve connecting portion 1815.

More specifically, the first control valve connecting portion 1815 may include a first high-pressure connection tube 1815*a*, a first low-pressure connection tube 1815*b*, and a first back pressure connection tube 1815*c*. The first high-pressure connection tube 1815*a* is a connection tube for providing high pressure (intermediate pressure) to the first variable-capacity opening and closing valve 1813, and the first low-pressure connection tube 1815*b* is a connection tube for providing low pressure (suction pressure) to the first variable-capacity opening and closing valve 1813. Also, the first back pressure connection tube 1815*c* is a connection tube for selectively providing high pressure or low pressure to the first variable-capacity opening and closing valve 1813. Accordingly, the first high-pressure connection tube 1815*a* and the first low-pressure connection tube 1815*b* may be connected to the first variable-capacity control valve 1814, and the first back pressure connection tube 1815*c* may be connected to the first variable-capacity opening and closing valve 1813 and the first variable-capacity control valve 1814.

For example, one or a first end of the first high-pressure connection tube 1815*a* may be connected to the back pressure chamber 160*a* through the casing 110, and another or a second end of the first high-pressure connection tube 1815*a* may be connected to the first control valve housing 1814*a* of the first variable-capacity control valve 1814 at the outside of the casing 110. Accordingly, depending on whether power is applied to the first control valve member 1814*b*, refrigerant in the back pressure chamber 160*a*, which forms an intermediate pressure, may flow into the first control valve housing 1814*a*.

One or a first end of the first low-pressure connection tube 1815*b* may communicate with the low-pressure part 110*a* (suction space) of the casing 110 through the casing 110, and another or a second end of the first low-pressure connection tube 1815*b* may be connected to the first control valve housing 1814*a* of the first variable-capacity control valve 1814 at the outside of the casing 110. Accordingly, depending on whether power is applied to the first control valve member 1814*b*, refrigerant in the first control valve housing 1814*a* may flow into the low-pressure part 110*a* of the casing 110, which forms a suction pressure.

One or a first end of the first back pressure connection tube 1815*c* may be connected to the first opening and closing valve housing 1813*a* of the first variable-capacity opening and closing valve 1813 through the casing 110, and another or a second end of the first back pressure connection tube 1815*c* may be connected to the first control valve housing 1814*a* of the first variable-capacity control valve 1814 at the outside of the casing 110. Accordingly, depending on whether or not power is applied to the first control valve member 1814*b*, the first back pressure connection tube 1815*c* may be selectively connected to the first high-pressure connection tube 1815*a* or the first low-pressure connection tube 1815*b*. Accordingly, refrigerant of an intermediate pressure may be supplied to the first opening and closing valve housing 1813*a* such that the intermediate pressure is formed in the first opening and closing valve housing 1813*a*, or refrigerant inside of the first opening and closing valve housing 1813*a* may flow into the low-pressure part 110*a* of the casing 110, such that a suction pressure is formed in the first opening and closing valve housing 1813*a*.

Referring to FIGS. 2 to 7, the second variable-capacity unit 182 may be formed similarly to the first variable-capacity unit 181. In other words, the second variable-capacity unit 182 may include second variable-capacity passage 1821 that communicates with the second intermediate pressure chamber Vm2, second variable-capacity valve 1822 that opens and closes the second variable-capacity passage 1821, second variable-capacity opening and closing valve 1823 that controls opening and closing of the second variable-capacity valve 1822, and second variable-capacity control valve 1824 that controls opening and closing of the second variable-capacity opening and closing valve 1823. The second variable-capacity passage 1821, the second variable-capacity valve 1822, the second variable-capacity opening and closing valve 1823, and the second variable-capacity control valve 1824 may be formed substantially similarly to the first variable-capacity passage 1811, the first variable-capacity valve 1812, the first variable-capacity opening and closing valve 1813, and the first variable-capacity control valve 1814. Hereinafter, components that are the same as those of the first variable-capacity unit 181 will be explained briefly or replaced with the description of the first variable-capacity unit 181, and description will focus on components that are different from those of the first variable-capacity unit 181.

The second variable-capacity passage 1821 may include a second variable-capacity hole 1821*a*, a second valve receiving groove 1821*b*, and a second exhaust hole 1821*c*. The second variable-capacity hole 1821*a* is a bypass passage along which refrigerant inside of the second intermediate pressure Vm2 is bypassed, and the second valve receiving groove 1821*b* is a space in which the second variable-capacity valve 1822 discussed hereinafter is received. Also, the second exhaust hole 1821*c* is an exhaust passage along which the refrigerant bypassed through the second variable-capacity hole 1821*a* is guided to the low-pressure part 110*a* (suction space) of the casing 110. The second variable-capacity hole 1821*a*, the second valve receiving groove 1821*b*, and the second exhaust hole 1821*c* are similar to the previously described first variable-capacity hole 1811*a*, first valve receiving groove 1811*b*, and first discharge hole 1811*c*.

However, referring to FIGS. 2, 4, and 7, the second valve receiving groove 1821*b* is formed in a second side surface, which is an opposite side surface of the first valve receiving groove 1811*b*, of both side surfaces of the variable-capacity plate 180. Accordingly, the second variable-capacity hole 1821*a* may include a scroll-side second variable-capacity hole 1821*a*1 and a plate-side second variable-capacity hole 1821*a*2. The scroll-side second variable-capacity hole 1821*a*1 and the plate-side second variable-capacity hole 1821*a*2 may be formed on a same axis to form a single passage.

In addition, the second valve receiving groove 1821*b*, similarly to the first valve receiving groove 1811*b*, may be formed in an arcuate shape like U when projected in the axial direction, and may be recessed into the second side surface 180*c* of the variable-capacity plate 180 by a depth equal to or less than a half of a thickness of the variable-capacity plate 180. Accordingly, even if the second valve receiving groove 1821*b* overlaps the first valve receiving groove 1811*b* when projected in the axial direction, the second valve receiving groove 1821*b* does not interfere with the first valve receiving groove 1811*b* in the axial direction.

Also, referring to FIGS. 5 and 7, the second exhaust hole 1821*c*, like the first exhaust hole 1811*c*, may be formed through the outer circumferential surface of the variable-capacity plate 180 in the middle of the second valve receiving groove 1821*b*, but may not interfere with the first exhaust hole 1811*c*. Accordingly, the second variable-capacity opening and closing valve 1823 may be connected to an end portion of the second exhaust hole 1821*c*, while being separate from the first variable-capacity opening and closing valve 1813.

Referring to FIGS. 5 and 7, the second variable-capacity valve 1822, like the first variable-capacity valve 1812, may be configured as a reed valve having a second fixed portion 1822*a* and a second opening and closing portion 1822*b* that are received in both ends of the second valve receiving groove 1821*b*, respectively. However, the second variable-capacity valve 1822 may alternatively be configured such that the second fixed portion 1822*a* is fastened to a bottom surface of the second valve receiving groove 1822*a*, and thus, the second opening and closing portion 1822*b* opens and closes the end portion of the plate-side second variable-capacity hole 1821*a*2.

In addition, the second variable-capacity valves 1822, like the first variable-capacity valves 1812, may be disposed to be inversely symmetrical to each other with respect to an axial center of the rotary shaft 125. This may secure a circumferential distance between the second variable-capacity valves 1822 and minimize valve lengths of both the second variable-capacity valves 1822. Through this, interference between both the second variable-capacity valves 1822 may be suppressed or prevented while an assembly of the second variable-capacity valves 1822 and 1812 may be improved.

Referring to FIG. 5, the second variable-capacity opening and closing valve 1823, like the first variable-capacity opening and closing valve 1813, may include a second opening and closing valve housing 1823*a* and a second opening and closing valve member 1823*b*. The second opening and closing valve housing 1823*a* may be fastened to the outer circumferential surface of the variable-capacity plate 180, like the first opening and closing valve housing 1813*a*, and the second opening and closing valve member 1823*b* may be configured as a type of check valve that opens and closes the second exhaust hole 1821*c* by sliding according to a pressure difference between both side surfaces in the first opening and closing valve housing 1813*a*.

Referring to FIG. 5, the second variable-capacity control valve 1824, like the first variable-capacity control valve 1814, may include a second control valve housing 1824*a* and a second control valve member 1824*b*. The second control valve housing 1824*a* may be fastened to the outer circumferential surface of another side of the casing 110, and the second control valve member 1824*b* may be slidably inserted into the second control valve housing 1824*a*. Accordingly, depending on whether external power is input or not, the second control valve member 1824*b* may selectively supply refrigerant of an intermediate pressure or a suction pressure toward the second variable-capacity opening and closing valve 1823 while reciprocating in the second control valve housing 1824*a*. Through this, the second variable-capacity opening and closing valve 1823 may be operated by a difference in back pressure provided by the second variable-capacity control valve 1824.

The second variable-capacity control valve 1824 may be connected to the second variable-capacity opening and closing valve 1823 through the second control valve connecting portion 1825, to control the opening and closing operation of the second variable-capacity opening and closing valve 1823. The second control valve connecting portion 1825 may include a second high-pressure connection tube 1825*a*, a second low-pressure connection tube 1825*b*, and a second back pressure connection tube 1825*c*. The second high-pressure connection tube 1825*a* is a connection tube that has one or a first end connected to the back pressure chamber 160*a* to provide high pressure (intermediate pressure) to the second variable-capacity opening and closing valve 1823, and the second low-pressure connection tube 1825*b* is a connection tube that has one or a first end connected to the low-pressure part 110*a* of the casing 110 to provide low pressure (suction pressure) to the second variable-capacity opening and closing valve 1823. Also, the second back pressure connection tube 1825*c* is a connection tube that has one or a first end connected to the first opening and closing valve housing 1813*a* to selectively provide high pressure or low pressure to the first variable-capacity opening and closing valve 1813. Accordingly, the second high-pressure connection tube 1825*a* and the second low-pressure connection tube 1825*b* may be connected to the second variable-capacity control valve 1824, and the second back pressure connection tube 1825*c* may be connected to the second variable-capacity opening and closing valve 1823 and the second variable-capacity control valve 1824.

Although not shown in the drawing, the first control valve connecting portion 1815 and the second control valve connecting portion 1825 may be partially shared. For example, the first high pressure connection tube 1815*a* and the second high pressure connection tube 1825*a* may communicate with the back pressure chamber 160*a* through a single common connection tube (not shown), and may be branched from a middle of the common connection tube, such that one or a first side is connected to the first control valve housing 1814*a* and another or a second side is connected to the second control valve housing 1824*a*. This may simplify assembly of the high-pressure connection tubes 1815*a* and 1825*a*.

The scroll compressor according to this embodiment may obtain the following operating effects.

That is, in this embodiment, the first variable-capacity unit 181 and the second variable-capacity unit 182 may be disposed to communicate with compression chambers each having a different pressure, so that the compressor may operate by varying a compression capacity in three stages and/or four stages. Hereinafter, description will be given focusing on an example in which the compressor operates in three stages.

For example, when both the first variable-capacity unit 181 and the second variable-capacity unit 182 are in an open state at a high-pressure side (high-pressure side open state), the compressor performs a power operation. When the first variable-capacity unit 181 is in an open state at a low-pressure side (low-pressure side open state), the compressor performs a first saving operation. When the second variable-capacity unit 182 is in a low-pressure side open state, the compressor performs a second saving operation, in which cooling power is lower than that in the first saving operation.

Figure 8A:
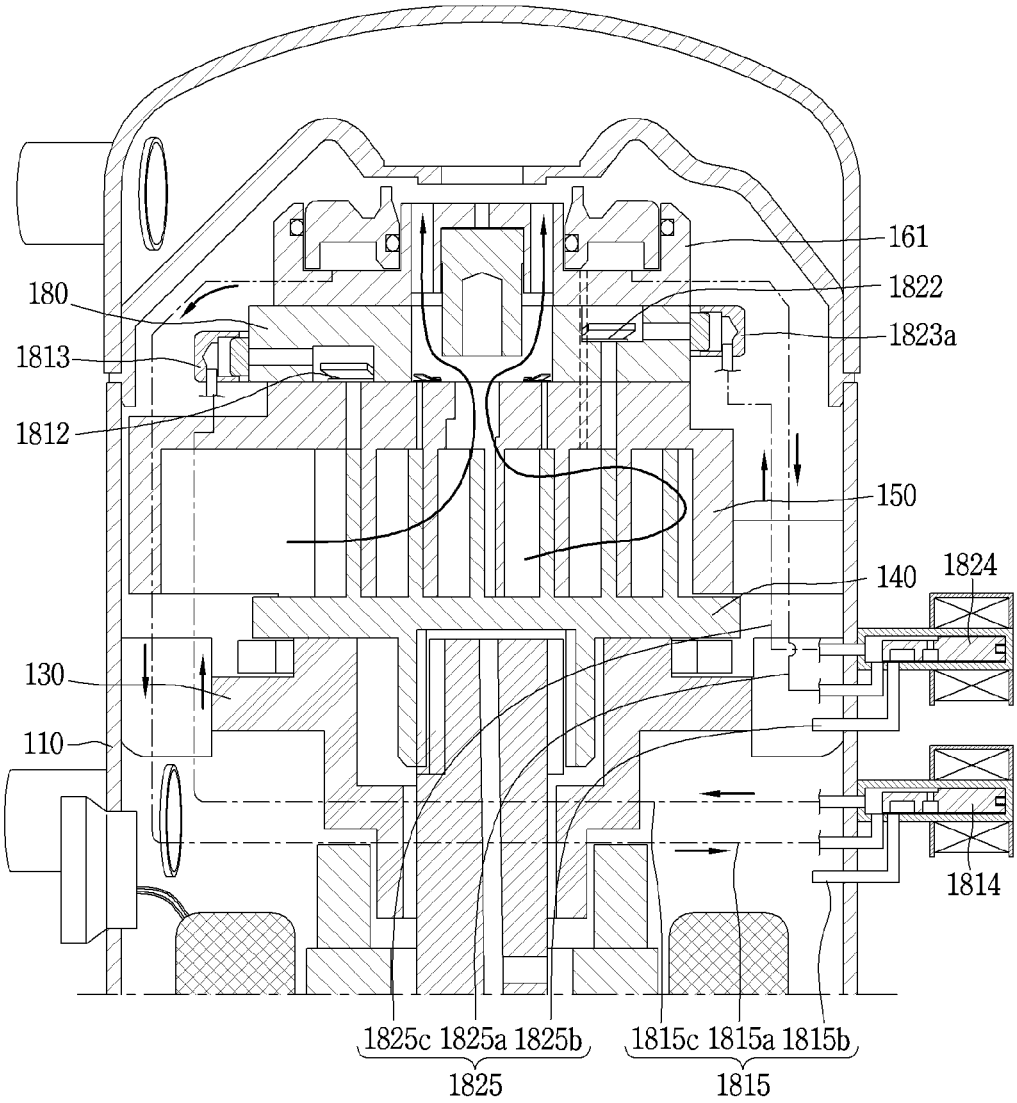
FIGS. 8A to 8C are schematic diagrams of operations of the first variable-capacity unit and the second variable-capacity unit according to an operating mode of the compressor, where
Figure 8B:
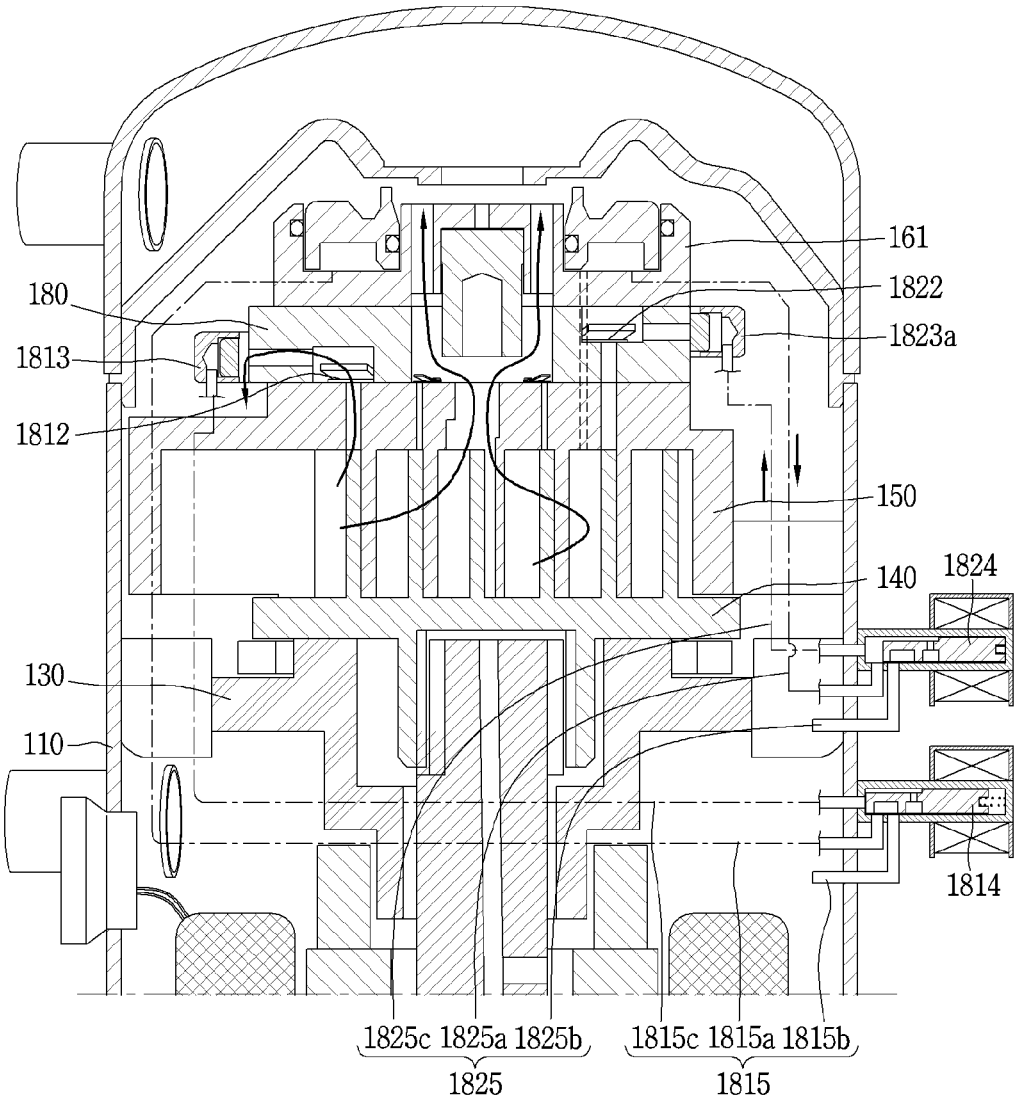
Figure 8C:
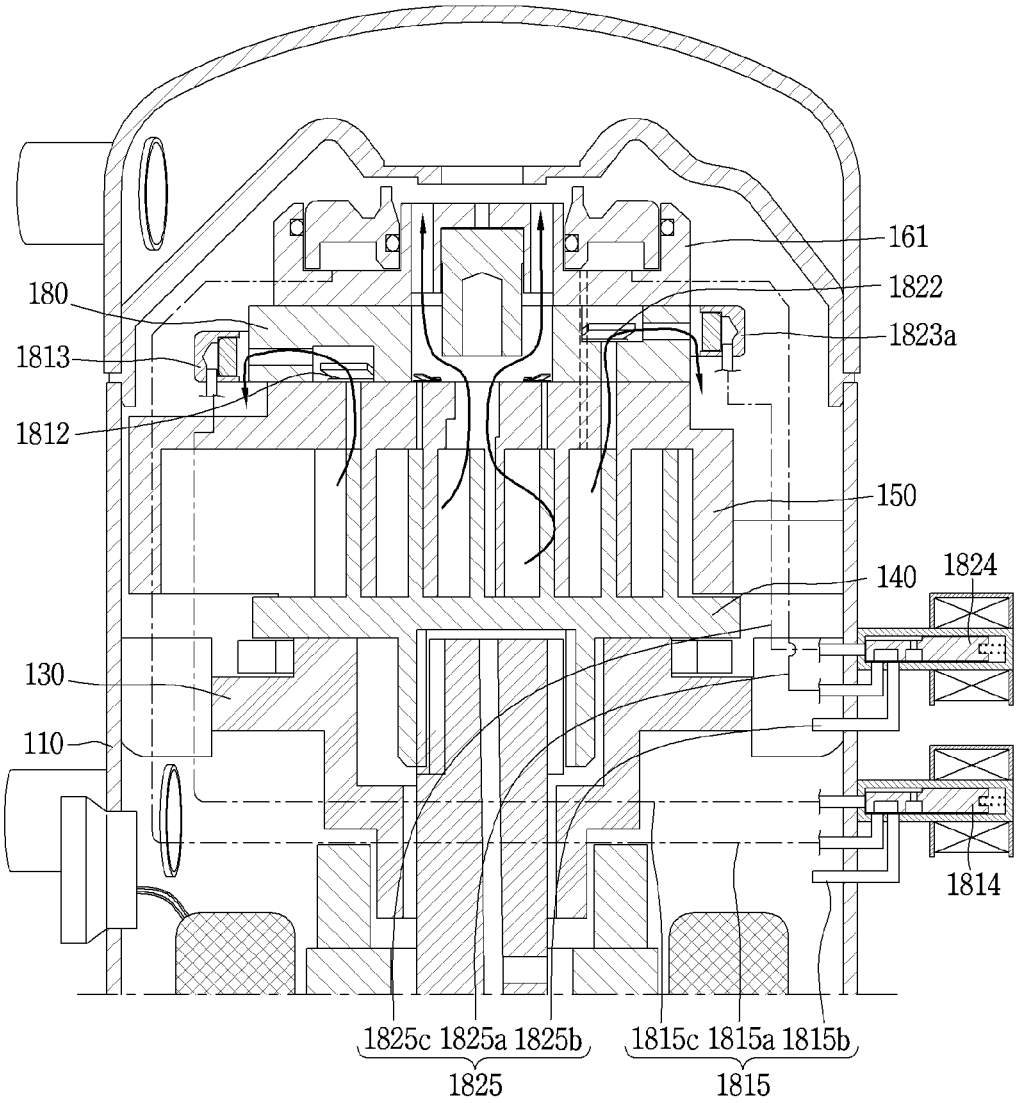

FIGS. 8A to 8C are schematic diagrams of operations of the first variable-capacity unit and the second variable-capacity unit according to an operating mode of the compressor. FIG. 8A shows a power mode, FIG. 8B shows a first saving mode, and FIG. 8C shows a second saving mode.

More specifically, during the power operation of the compressor as illustrated in FIG. 8A, power is applied to the first variable-capacity control valve 1814, which forms a portion of the first variable-capacity unit 181, and the second variable-capacity control valve 1824, which forms a portion of the second variable-capacity unit 182. Accordingly, the first control valve member 1814*b* of the first variable-capacity control valve 1814 and the second control valve member 1824*b* of the second variable-capacity control valve 1824 are pulled toward the drive units, respectively.

Then, the first control valve housing 1814*a* is connected to the first high-pressure connection tube 1815*a*, and the second control valve housing 1824*a* is connected to the second high-pressure connection tube 1825*a*. Accordingly, refrigerant in the back pressure chamber 160*a* which forms a high pressure (intermediate pressure) is supplied to the first differential pressure space 1813*a*2 of the first opening and closing valve housing 1813*a* and the second opening and closing valve housing 1824*a* through the first back pressure connection tube 1815*c* and the second back pressure connection tube, respectively.

Then, the pressure in the first opening and closing valve housing 1813*a* and the pressure in the second opening and closing valve housing 1823*a* form an intermediate pressure that is a high pressure, so that the first opening and closing valve member 1813*b* closes the first exhaust hole 1811*c* and the second opening and closing valve member 1823*b* closes the second exhaust hole 1821*c*, respectively.

Accordingly, the first variable-capacity valve 1812 and the second variable-capacity valve 1822 are maintained in the closed state, so that suctioned refrigerant is compressed while continuously moving up to discharge pressure chambers from the first intermediate pressure chamber Vm1 and the second intermediate pressure chamber Vm2 without being bypassed. Accordingly, the compressor continues the power operation using 100% of its capacity.

Next, during the first saving operation as illustrated in FIG. 8B, power is not applied to the first variable-capacity control valve 1814, which forms the portion of the first variable-capacity unit 181, while being applied only to the second variable-capacity control valve 1824, which forms the portion of the second variable-capacity unit 182. Then, the first control valve member 1814*b* of the first variable-capacity control valve 1814 is pushed toward the opposite side of the drive unit, while the second control valve member 1824*b* of the second variable-capacity control valve 1824 is pulled toward the drive unit.

The first control valve housing 1814*a* is connected to the first low-pressure connection tube 1815*b*, such that the first opening and closing valve housing 1813*a* communicates with the low-pressure part 110*a* (suck space) of the casing 110 through the first back pressure connection tube 1815*c*. At this time, the second control valve housing 1824*a* is connected to the second high-pressure connection tube 1825*a*, such that refrigerant in the back pressure chamber 160*a*, which forms a high pressure (intermediate pressure), is supplied to the second opening and closing valve housing 1824*a* through the second back pressure connection tube 1825*c*.

Then, a low pressure is formed in the first differential pressure space 1813*a*2, and thus, the first opening and closing valve member 1813*b* is pushed out by internal pressure of the first valve receiving groove 1811*b*, thereby opening the first exhaust hole 1811*c*. An inner space of the first valve receiving groove 1811*b* communicates with the low-pressure part 110*a* of the casing 110 through the first exhaust through-hole 1813*c* of the first opening and closing valve housing 1813*a*, such that the pressure on a back pressure surface of the first variable-capacity valve 1812 becomes lower than the pressure of the first intermediate pressure chamber Vm1.

The first opening and closing portion 1812*b* of the first variable-capacity valve 1812 is then pushed and opened by the pressure of the first intermediate pressure chamber Vm1, thereby opening the first variable-capacity hole 1811*a*. Then, some of the refrigerant in the first intermediate pressure chamber Vm1 flows into the first valve receiving groove 1811*b* through the first variable-capacity hole 1811*a* and is bypassed to the low-pressure part 110*a* of the casing 110 through the first exhaust hole 1811*c* and the first exhaust through-hole 1813*c*.

At this time, as the refrigerant of the back pressure chamber 160*a* forming the high pressure (intermediate pressure) is supplied to the second opening and closing valve housing 1823*a*, the second opening and closing valve member 1823*b* closes the second exhaust hole 1821*c*. Accordingly, the second variable-capacity valve 1822 is maintained in the closed state, so that the refrigerant passed through the first intermediate pressure chamber Vm1 is compressed while moving up to the discharge pressure chamber without being bypassed from the second intermediate pressure chamber Vm2. Accordingly, the compressor performs the first saving operation using approximately 60 to 70% of its capacity.

Next, during the second saving operation of the compressor as illustrated in FIG. 8C, power is not applied to the first variable-capacity control valve 1814, which forms a portion of the first variable-capacity unit 181, and the second variable-capacity control valve 1824, which forms a portion of the second variable-capacity unit 182. Accordingly, the first control valve member 1814*b* of the first variable-capacity control valve 1814 and the second control valve member 1824*b* of the second variable-capacity control valve 1824 are pulled toward opposite sides of the drive units, respectively.

Then, the first control valve housing 1814*a* is connected to the first low-pressure connection tube 1815*b*, and the second control valve housing 1824*a* is connected to the second low-pressure connection tube 1825*b*. The first opening and closing valve housing 1813*a* and the second opening and closing valve housing 1823*a* communicate with the low-pressure part 110*a* of the casing 110 forming a low pressure (suction pressure).

Pressure in the first opening and closing valve housing 1813*a* and pressure in the second opening and closing valve housing 1823*a* form a suction pressure which is a low pressure, so that the first opening and closing valve member 1813*b* opens the first exhaust hole 1811*c* and the second opening and closing valve member 1823*b* opens the second exhaust hole 1821*c*, respectively. Accordingly, the first variable-capacity valve 1812 and the second variable-capacity valve 1822 are switched to the open state, so that suctioned refrigerant is partially bypassed from the first intermediate pressure chamber Vm1 and the second intermediate pressure chamber Vm2. Then, only the portion of the suctioned refrigerant is compressed while moving up to the discharge pressure chambers. Accordingly, the compressor performs the second saving operation using approximately less than 60% of its capacity.

Although not shown in the drawing, in FIG. 8C, the first variable-capacity unit 181 may be controlled to close the first variable-capacity hole 1811*a*. In this case, more refrigerant moves to the discharge pressure chamber than in the operating mode according to FIG. 8C, so that a capacity reduction rate of the compressor may be lower than that in the first saving operation but higher than that in the second saving operation. In other words, in the embodiments, operation of the compressor may be performed in four stages by controlling the opening and closing operations of the first variable-capacity unit 181 and the second variable-capacity unit 182.

In this way, a variable-capacity device for varying a compression capacity may be simplified, thereby easily manufacturing a scroll compressor having the variable-capacity device and quickly varying the compression capacity. Further, as a variable-capacity unit is provided as a plurality, the compression capacity may be controlled in various ways.

Furthermore, as the plurality of variable-capacity units is in communication with intermediate pressure chambers each having a different pressure, the operation capacity may be controlled in three or more stages, and thus, a variable-capacity ratio may be further lowered to increase energy efficiency.

Hereinafter, description will be given of a variable-capacity unit according to another embodiment. That is, in the previous embodiment, the first variable-capacity unit and the second variable-capacity unit each are received in the variable-capacity plate, but in some cases, one variable-capacity unit may be received in the variable-capacity plate and another variable-capacity unit may be received in the non-orbiting scroll.

Figure 9:
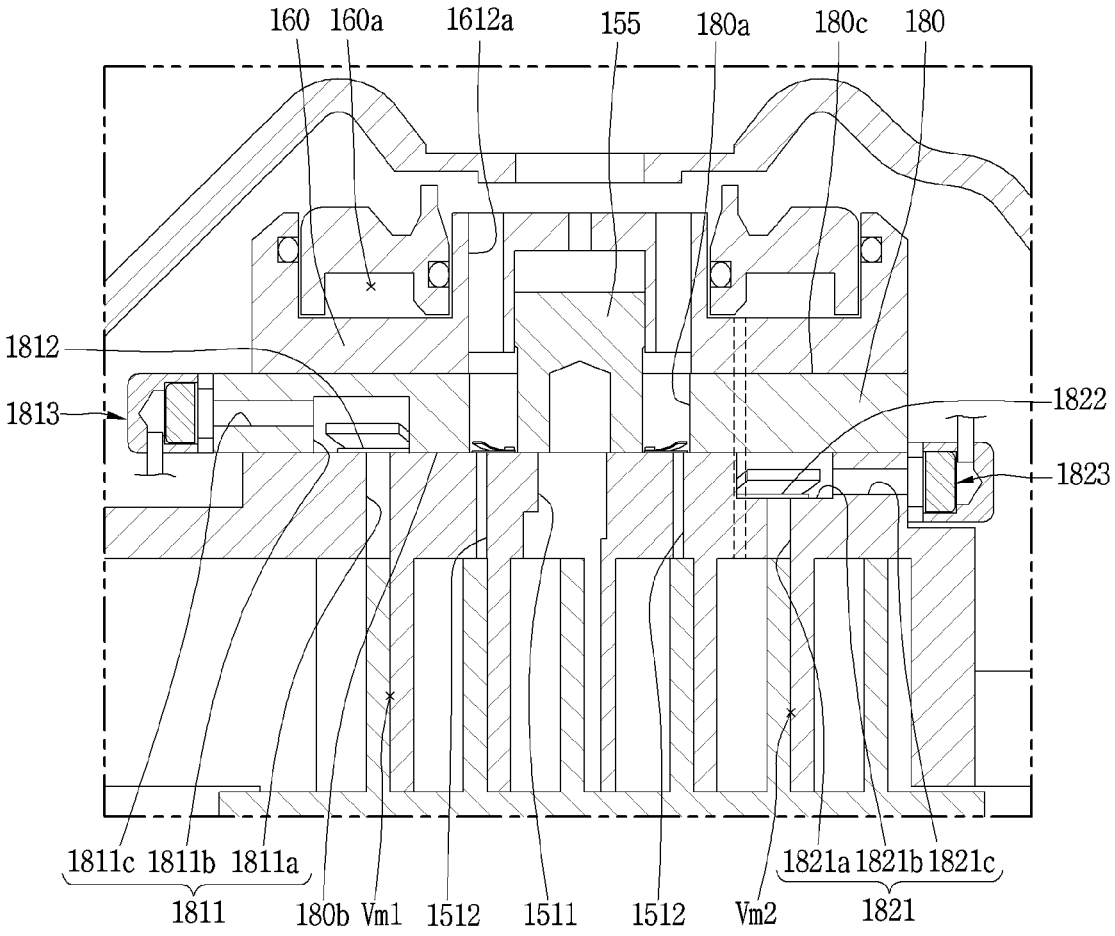
FIG. 9 is a longitudinal cross-sectional view of a variable-capacity device in FIG. 5 according to another embodiment.

FIG. 9 is a longitudinal cross-sectional view of a variable-capacity device in FIG. 5 according to another embodiment. Referring to FIG. 9, the basic configuration and operational effects of the scroll compressor according to this embodiment may be similar to those of the scroll compressor according to the embodiment of FIG. 5 described above. For example, in the scroll compressor according to this embodiment, drive motor 120, main frame 130, orbiting scroll 140, non-orbiting scroll 150, back pressure chamber assembly 160, and variable-capacity plate 180 may be disposed inside of the casing 110. Also, first variable-capacity unit 181 may be disposed between the non-orbiting scroll 150 and the variable-capacity plate 180, and second variable-capacity unit 182 may be disposed between the back pressure chamber assembly 160 and the variable-capacity plate 180.

In addition, the first variable-capacity unit 181 and the second variable-capacity unit 182 may be substantially similar to the first variable-capacity unit 181 and the second variable-capacity unit 182 in the previous embodiment of FIG. 5. Therefore, repetitive description thereof has been omitted.

However, in this embodiment, the first valve receiving groove 1811*b*, which forms a portion of the first variable-capacity unit 181, may be disposed on the rear surface of the non-orbiting scroll 150 facing the first side surface 180*b* of the variable-capacity plate 180. In other words, the first valve receiving groove 1811*b* may be formed to be recessed by a preset or predetermined depth into the rear surface of the non-orbiting scroll 150, and the first variable-capacity valve 1812 may be inserted into the first valve receiving groove 1811*b*. This may reduce lengths of the first variable-capacity holes 1811*a* penetrating from both ends of the first valve receiving groove 1811*b* to the first intermediate pressure chamber Vm1, thereby reducing a dead volume due to the first variable-capacity holes 1811*a*.

Also, the first exhaust hole 1811*c* according to this embodiment may be formed through the non-orbiting scroll 150. In other words, as the first valve receiving groove 1811*b* is formed to be recessed by the preset depth into the rear surface of the non-orbiting scroll 150, the first exhaust hole 1811*c* may be formed to penetrate from the outer circumferential surface of the first valve receiving groove 1811*b* to the outer circumferential surface of the non-orbiting scroll 150. In this case, the first variable-capacity opening and closing valve 1813 may be coupled to the outer circumferential surface of the non-orbiting scroll 150. Accordingly, the first valve receiving groove 1811*b* and the first exhaust hole 1811*c* may be excluded from the variable-capacity plate 180, thereby facilitating machining of the variable-capacity plate 180.

In addition, the second valve receiving groove 1821*b* according to this embodiment may be formed to be recessed by a preset or predetermined depth into the second side surface 180*c* of the variable-capacity plate 180 as in the embodiment of FIG. 5 described above. A depth of the second valve receiving groove 1821*b* may be equal to or greater than a half of the thickness of the variable-capacity plate 180. This may reduce the thickness of the variable-capacity plate 180, so as to reduce material costs as well as a length and weight of the compressor.

Although not shown in the drawings, the first variable-capacity unit 181 may be received in the variable-capacity plate 180 and the second variable-capacity unit 182 may be received in the non-orbiting scroll 150. As its configuration and effects are similar to those in the embodiment of FIG. 5 described above, description thereof has been omitted.

Hereinafter, description will be given of a variable-capacity unit according to still another embodiment. That is, in the previous embodiments, the first variable-capacity unit and/or the second variable-capacity unit are received in the variable-capacity plate and/or the non-orbiting scroll, but in some cases, the first variable-capacity unit and/or the second variable-capacity unit may alternatively be received in the back pressure chamber assembly.

Figure 10:
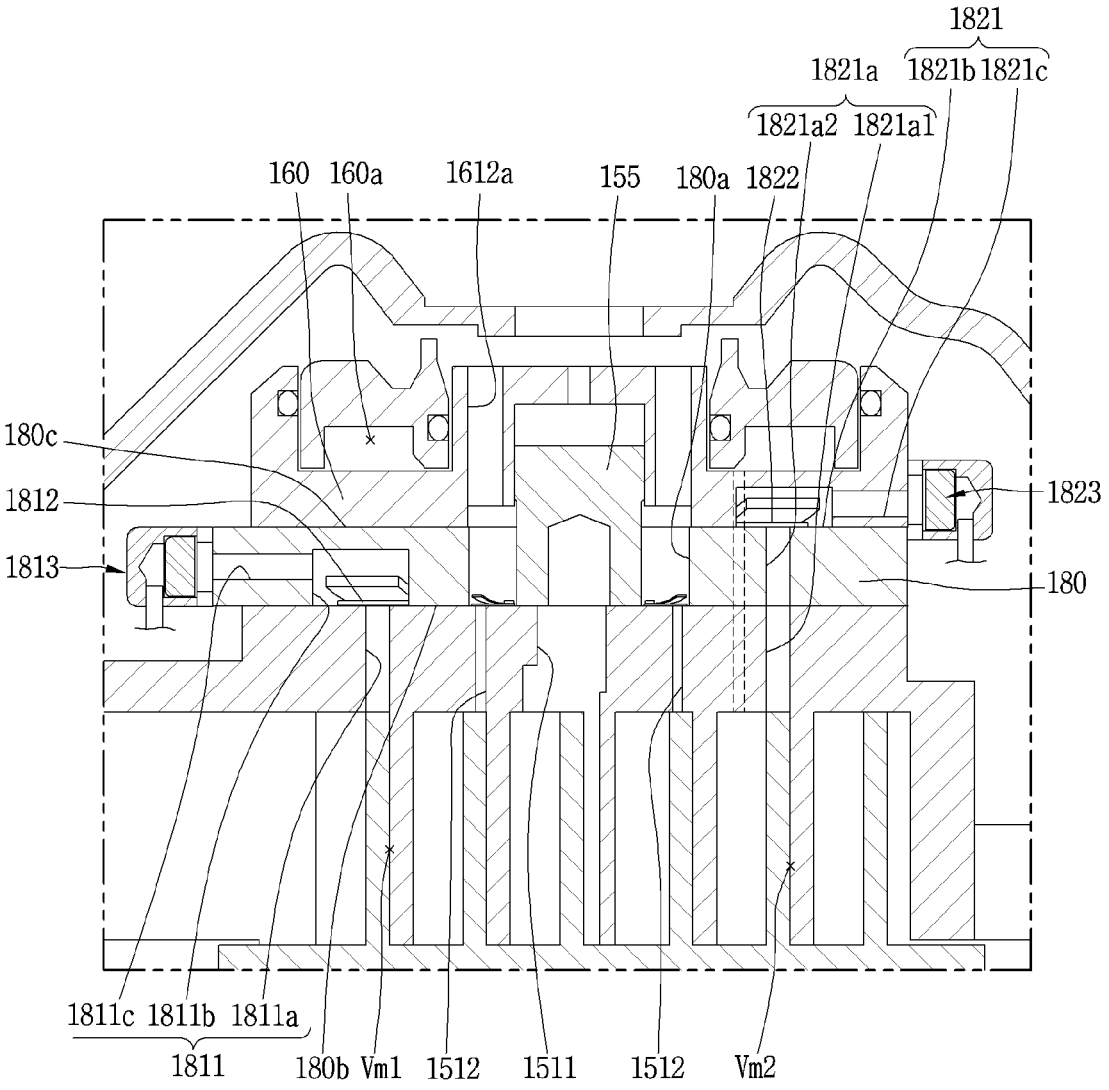
FIG. 10 is a longitudinal cross-sectional view of a variable-capacity device in FIG. 5 according to another embodiment.

FIG. 10 is a longitudinal cross-sectional view of variable-capacity device in FIG. 5 according to another embodiment. Referring to FIG. 10, the basic configuration and operational effects of the scroll compressor according to this embodiment may be similar to those of the scroll compressors according to the embodiment of FIG. 5 and the embodiment of FIG. 9. For example, in the scroll compressor according to this embodiment, drive motor 120, main frame 130, orbiting scroll 140, non-orbiting scroll 150, back pressure chamber assembly 160, and variable-capacity plate 180 may be disposed inside of the casing 110. Also, first variable-capacity unit 181 may be disposed between the non-orbiting scroll 150 and the variable-capacity plate 180, and second variable-capacity unit 182 may be disposed between the back pressure chamber assembly 160 and the variable-capacity plate 180.

In addition, the first variable-capacity unit 181 and the second variable-capacity unit 182 may be substantially similar to the first variable-capacity units 181 and the second variable-capacity units 182 in the previous embodiments of FIGS. 5 and 9. Therefore, repetitive description thereof has been omitted.

However, in this embodiment, the second valve receiving groove 1821*b*, which forms the portion of the second variable-capacity unit 182, may be disposed on the rear surface of the back pressure plate 161 facing the second side surface 180*c* of the variable-capacity plate 180. In other words, the second valve receiving groove 1821*b* may be formed to be recessed by a preset or predetermined depth into the rear surface of the back pressure plate 161, and the second variable-capacity valve 1822 may be inserted into the second valve receiving groove 1821*b*.

Also, in this case, lengths of the second variable-capacity holes 1821*a* that penetrate from both ends of the second valve receiving groove 1821*b* to the second intermediate pressure chamber Vm2 may be reduced, thereby reducing a dead volume due to the second variable-capacity hole 1821*a*.

Also, the second exhaust hole 1821*c* according to this embodiment may be formed through the back pressure plate 161. In other words, as the second valve receiving groove 1821*b* is formed to be recessed by the preset depth into the rear surface of the back pressure plate 161 (more specifically, the fixed plate portion), the second exhaust hole 1821*c* may be formed to penetrate from the outer surface of the second valve receiving groove 1821*b* to the outer circumferential surface of the back pressure plate 161. In this case, the second variable-capacity opening and closing valve 1823 may be coupled to the outer circumferential surface of the back pressure plate 161. Accordingly, the second valve receiving groove 1821*b* and the second exhaust hole 1821*c* may be excluded from the variable-capacity plate 180, thereby facilitating machining of the variable-capacity plate 180.

In addition, the first valve receiving groove 1811*b* according to this embodiment may be formed to be recessed by a preset or predetermined depth into the first side surface 180*b* of the variable-capacity plate 180 as in the embodiment of FIG. 5 described above. A depth of the first valve receiving groove 1811*b* may be equal to or greater than a half of a thickness of the variable-capacity plate 180. This may reduce the thickness of the variable-capacity plate 180, so as to reduce material costs as well as the length and weight of the compressor.

Although not shown in the drawings, both the first variable-capacity unit 181 and the second variable-capacity unit 182 may be received in the rear surface of the back pressure plate 161. As its configuration and effects are similar to those in the embodiment of FIG. 5 and the embodiment of FIG. 9, description thereof has been omitted.

In the foregoing embodiments, descriptions were given focusing on the example in which the first variable-capacity valve 1813 and the second variable-capacity valve 1823 were configured as the reed valves, but these variable-capacity valves 1813 and 1823 may alternatively be piston valves. In addition, in the foregoing embodiments, a low-pressure scroll compressor has been described as an example; however, embodiments may equally be applied to any hermetic compressor in which an inner space of a casing is divided into a low-pressure portion as a suction space and a high-pressure portion as a discharge space.

Embodiments disclosed herein provide a scroll compressor that is capable of easily implementing a variable-capacity device.

Embodiments disclosed herein further provide a scroll compressor that is capable of increasing energy efficiency by lowering a variable-capacity ratio.

Embodiments disclosed herein furthermore provide a scroll compressor that is capable of further reducing a variable-capacity ratio by controlling an operation capacity by three steps or more.

Embodiments disclosed herein also provide a scroll compressor that is capable of decreasing a dead volume while lowering a variable-capacity ratio.

Embodiments disclosed herein provide a scroll compressor that may include a casing, an orbiting scroll, a non-orbiting scroll, a back pressure chamber assembly, a first variable-capacity unit, and a second variable-capacity unit. The casing may have a hermetic inner space, which may be divided into a low-pressure part or portion and a high-pressure part or portion. The orbiting scroll may be coupled to a rotary shaft in the inner space of the casing to perform an orbiting motion. The non-orbiting scroll may form compression chambers each having a suction pressure chamber, an intermediate pressure chamber, and a discharge pressure chamber, together with the orbiting scroll. The back pressure chamber assembly may be coupled to the non-orbiting scroll to form a back pressure chamber. The first variable-capacity unit may be configured to vary a compression capacity by selectively providing communication between a first intermediate pressure chamber having a first pressure, of the intermediate pressure chambers, and the low-pressure part. The second variable-capacity unit may be configured to vary the compression capacity by selectively provides communication between a second intermediate pressure chamber having second pressure higher than the first pressure, of the intermediate pressure chambers, and the low-pressure part. As the variable-capacity unit is provided as a plurality, the compression capacity may be controlled in multiple stages so as to enhance energy efficiency.

For example, the first variable-capacity unit may include a first variable-capacity passage that communicates with the first intermediate pressure chamber, a first variable-capacity valve for that opens and closes the first variable-capacity passage, and a first variable-capacity opening and closing valve that controls opening and closing of the first variable-capacity valve. The second variable-capacity unit may include a second variable-capacity passage that communicates with the second intermediate pressure chamber, a second variable-capacity valve for that opens and closes the second variable-capacity passage, and a second variable-capacity opening and closing valve that controls opening and closing of the second variable-capacity valve. Through this, energy efficiency may be enhanced by providing the variable-capacity unit as a plurality. Also, the scroll compressor having the variable-capacity units may be easily manufactured and simultaneously a compression capacity may be quickly varied by simplifying the variable-capacity units.

For example, a variable-capacity plate may be disposed between the non-orbiting scroll and the back pressure chamber assembly. At least one of the first variable-capacity unit or the second variable-capacity unit may be received in the variable-capacity plate. Through this, the plurality of variable-capacity units may be installed without enlarging an outer diameter of the non-orbiting scroll.

For example, a first valve receiving groove may be formed in a first side surface of the variable-capacity plate facing the non-orbiting scroll to receive the first variable-capacity valve, and a first exhaust passage opened and closed by the first variable-capacity opening and closing valve may be formed between an outer circumferential surface of the variable-capacity plate and the first valve receiving groove. A second valve receiving groove may be formed in a second side surface of the variable-capacity plate facing the back pressure chamber assembly to receive the second variable-capacity valve, and a second exhaust passage opened and closed by the second variable-capacity opening and closing valve may be formed between the outer circumferential surface of the variable-capacity plate and the second valve receiving groove. Through this, the structure of the non-orbiting scroll may be simplified while employing the plurality of variable-capacity units.

The first variable-capacity passage may include a first variable-capacity hole formed through the non-orbiting scroll such that the first intermediate pressure chamber and the first valve receiving groove communicate with each other. The second variable-capacity passage may include a scroll-side second variable-capacity hole formed through the non-orbiting scroll to communicate with the second intermediate pressure chamber, and a plate-side second variable-capacity hole formed through the variable-capacity plate such that the scroll-side second variable-capacity hole and the second valve receiving groove communicate with each other. As the plurality of variable-capacity parts are disposed with a height difference, interference between the plurality of variable-capacity units may be suppressed or prevented.

The first valve receiving groove may be formed in an arcuate shape to receive first variable-capacity valves in both sides thereof, the first exhaust passage may penetrate through the outer circumferential surface of the variable-capacity plate in a middle of the first valve receiving groove, and the first variable-capacity opening and closing valve may be disposed on the outer circumferential surface of the variable-capacity plate to selectively open and close the first exhaust passage. The second valve receiving groove may be formed in an arcuate shape to receive second variable-capacity valves in both sides thereof, the second exhaust passage may penetrate through the outer circumferential surface of the variable-capacity plate in a middle of the second valve receiving groove, and the second variable-capacity opening and closing valve may be disposed on the outer circumferential surface of the variable-capacity plate to selectively open and close the second exhaust passage. By simplifying the variable-capacity passage, the number of valves for opening and closing the variable-capacity passage may be reduced, thereby reducing manufacturing costs of a variable-capacity scroll compressor.

The first variable-capacity valve may include a first fixed portion coupled to the non-orbiting scroll, and a first opening and closing portion that opens and closes the first variable-capacity passage. The second variable-capacity valve may include a second fixed portion coupled to the variable-capacity plate, and a second opening and closing portion that opens and closes the second variable-capacity passage. The first variable-capacity valve may be disposed to be inversely symmetrical to another neighboring first variable-capacity valve based on the rotary shaft, and the second variable-capacity valve may be disposed to be inversely symmetrical to another neighboring second variable-capacity valve based on the rotary shaft. This may secure a circumferential distance between both the variable-capacity valves and minimize valve lengths of the variable-capacity valves, thereby improving assembly for each of the variable-capacity valve.

The first valve receiving groove and the second valve receiving groove may at least partially overlap each other when projected in an axial direction. This may facilitate disposition of the plurality of variable-capacity units.

As another example, one of the first variable-capacity unit or the second variable-capacity unit may be received in the variable-capacity plate, and another variable-capacity unit may be received in the non-orbiting scroll. This may minimize a length of a variable-capacity hole disposed in the non-orbiting scroll, thereby reducing a dead volume generated due to the variable-capacity hole.

For example, a first valve receiving groove may be formed in one or a first side surface of the non-orbiting scroll facing one or a first side surface of the variable-capacity plate to receive the first variable-capacity valve. A second valve receiving groove may be formed in another or a second side surface of the variable-capacity plate facing the back pressure chamber assembly to receive the second variable-capacity valve. This may simplify the structure of the variable-capacity plate and reduce a thickness of the variable-capacity plate.

A first exhaust passage may be formed in the variable-capacity plate and communicate with the first valve receiving groove to be opened and closed by the first variable-capacity opening and closing valve. A second exhaust passage may be formed in the back pressure chamber assembly and communicate with the second valve receiving groove to be opened and closed by the second variable-capacity opening and closing valve. This may simplify the structure of the variable-capacity plate while separating both exhaust passages from each other.

One of the first variable-capacity valve or the second variable-capacity valve may be fastened to the back pressure chamber assembly. Accordingly, the first variable-capacity valve and the second variable-capacity valve may be received in different members while increasing the assembly property of both the variable-capacity valves.

As another example, at least one of the first variable-capacity unit or the second variable-capacity unit may be received in the back pressure chamber assembly. This may simplify the structure of the variable-capacity plate and reduce the thickness of the variable-capacity plate.

For example, a first valve receiving groove may be formed in one or a first side surface of the non-orbiting scroll facing the back pressure chamber assembly to receive the first variable-capacity valve. A second valve receiving groove may be formed in another or a second side surface of the back pressure chamber assembly facing the non-orbiting scroll to receive the second variable-capacity valve.

A first exhaust passage may be formed in the non-orbiting scroll and communicate with the first valve receiving groove to be opened and closed by the first variable-capacity opening and closing valve. A second exhaust passage may be formed in the back pressure chamber assembly and communicate with the second valve receiving groove to be opened and closed by the second variable-capacity opening and closing valve. This may simplify the structure of the variable-capacity plate while separating both exhaust passages from each other.

More specifically, one of the first variable-capacity valve or the second variable-capacity valve may be fastened to the back pressure chamber assembly. Accordingly, the first variable-capacity valve and the second variable-capacity valve may be received in different members while increasing the assembly of both the variable-capacity valves.

As another example, an overcompression suppressing portion may be disposed to selectively provide communication between the intermediate pressure chamber or the discharge pressure chamber and the high-pressure part. Accordingly, the plurality of variable-capacity units may be provided while suppressing or preventing overcompression in a compression chamber by the overcompression suppressing portion.

As another example, a first variable-capacity control valve and a second variable-capacity control valve may be disposed on the outer circumferential surface of the casing. A first connecting portion may be connected between the first variable-capacity opening and closing valve and the first variable-capacity control valve, and a second connecting portion may be connected between the second variable-capacity opening and closing valve and the second variable-capacity control valve. Accordingly, the first variable-capacity control valve and the second variable-capacity control valve may be installed outside of the compressor, and may be connected to the variable-capacity opening and closing valves through connecting portions, respectively, thereby accurately and effectively controlling operating modes.

It will be understood that when an element or layer is referred to as being "on" another element or layer, the element or layer can be directly on another element or layer or intervening elements or layers. In contrast, when an element is referred to as being "directly on" another element or layer, there are no intervening elements or layers present. As used herein, the term "and/or" includes any and all combinations of one or more of the associated listed items.

It will be understood that, although the terms first, second, third, etc., may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section could be termed a second element, component, region, layer or section without departing from the teachings of the present invention.

Spatially relative terms, such as "lower", "upper" and the like, may be used herein for ease of description to describe the relationship of one element or feature to another element (s) or feature(s) as illustrated in the figures. It will be understood that the spatially relative terms are intended to encompass different orientations of the device in use or operation, in addition to the orientation depicted in the figures. For example, if the device in the figures is turned over, elements described as "lower" relative to other elements or features would then be oriented "upper" relative to the other elements or features. Thus, the exemplary term "lower" can encompass both an orientation of above and below. The device may be otherwise oriented (rotated 90 degrees or at other orientations) and the spatially relative descriptors used herein interpreted accordingly.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Embodiments are described herein with reference to cross-section illustrations that are schematic illustrations of idealized embodiments (and intermediate structures). As such, variations from the shapes of the illustrations as a result, for example, of manufacturing techniques and/or tolerances, are to be expected. Thus, embodiments should not be construed as limited to the particular shapes of regions illustrated herein but are to include deviations in shapes that result, for example, from manufacturing.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Any reference in this specification to "one embodiment," "an embodiment," "example embodiment," etc., means that a particular feature, structure, or characteristic described in connection with the embodiment is included in at least one embodiment. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A scroll compressor, comprising:

a casing having a hermetic inner space divided into a low-pressure portion and a high-pressure portion;

an orbiting scroll coupled to a rotary shaft in the inner space of the casing to perform an orbiting motion;

a non-orbiting scroll forming compression chambers, each having a suction pressure chamber, an intermediate pressure chamber, and a discharge pressure chamber, together with the orbiting scroll;

a back pressure chamber assembly coupled to the non-orbiting scroll to form a back pressure chamber;

a first variable-capacity unit configured to vary a compression capacity by selectively providing communication between a first intermediate pressure chamber having a first pressure, of the intermediate pressure chambers, and the low-pressure portion; and a second variable-capacity unit configured to vary the compression capacity by selectively providing communication between a second intermediate pressure chamber having a second pressure higher than the first pressure, of the intermediate pressure chambers, and the low-pressure portion, wherein the first variable-capacity unit comprises a first variable-capacity passage that communicates with the first intermediate pressure chamber, at least one first variable-capacity valve that opens and closes the first variable-capacity passage, and a first variable-capacity opening and closing valve for that controls opening and closing of the at least one first variable-capacity valve, and the second variable-capacity unit comprises a second variable-capacity passage that communicates with the second intermediate pressure chamber, at least one second variable-capacity valve that opens and closes the second variable-capacity passage, and a second variable-capacity opening and closing valve that controls opening and closing of the at least one second variable-capacity valve.

2. The scroll compressor of claim 1, wherein a variable-capacity plate is disposed between the non-orbiting scroll and the back pressure chamber assembly, and wherein at least one of the first variable-capacity unit or the second variable-capacity unit is received in the variable-capacity plate.

3. The scroll compressor of claim 2, wherein a first valve receiving groove is formed in a first side surface of the variable-capacity plate facing the non-orbiting scroll to receive the at least one first variable-capacity valve, and a first exhaust passage opened and closed by the first variable-capacity opening and closing valve is formed between an outer circumferential surface of the variable-capacity plate and the first valve receiving groove, and a second valve receiving groove is formed in a second side surface of the variable-capacity plate facing the back pressure chamber assembly to receive the at least one second variable-capacity valve, and a second exhaust passage opened and closed by the second variable-capacity opening and closing valve is formed between the outer circumferential surface of the variable-capacity plate and the second valve receiving groove.

4. The scroll compressor of claim 3, wherein the first variable-capacity passage includes at least one first variable-capacity hole formed through the non-orbiting scroll such that the first intermediate pressure chamber and the first valve receiving groove communicate with each other, and the second variable-capacity passage includes at least one scroll-side second variable-capacity hole formed through the non-orbiting scroll to communicate with the second intermediate pressure chamber, and at least one plate-side second variable-capacity hole formed through the variable-capacity plate such that the at least one scroll-side second variable-capacity hole and the second valve receiving groove communicate with each other.

5. The scroll compressor of claim 4, wherein the at least one first variable-capacity valve comprises a plurality of first variable-capacity valves, the first valve receiving groove is formed in an arcuate shape to receive the plurality of first variable-capacity valves in both sides thereof, the first exhaust passage penetrates through the outer circumferential surface of the variable-capacity plate in a middle of the first valve receiving groove, and the first variable-capacity opening and closing valve is disposed on the outer circumferential surface of the variable-capacity plate to selectively open and close the first exhaust passage, and wherein the at least one second variable-capacity valve comprises a plurality of second variable-capacity valves, the second valve receiving groove is formed in an arcuate shape to receive the plurality of second variable-capacity valves in both sides thereof, the second exhaust passage penetrates through the outer circumferential surface of the variable-capacity plate in a middle of the second valve receiving groove, and the second variable-capacity opening and closing valve is disposed on the outer circumferential surface of the variable-capacity plate to selectively open and close the second exhaust passage.

6. The scroll compressor of claim 5, wherein each of the plurality of first variable-capacity valves includes a first fixed portion coupled to the non-orbiting scroll, and a first opening and closing portion that opens and closes the first variable-capacity passage, wherein each of the plurality of second variable-capacity valves includes a second fixed portion coupled to the variable-capacity plate, and a second opening and closing portion that opens and closes the second variable-capacity passage, and wherein the first variable-capacity valve is disposed to be inversely symmetrical to another neighboring first variable-capacity valve based on the rotary shaft, and the second variable-capacity valve is disposed to be inversely symmetrical to another neighboring second variable-capacity valve based on the rotary shaft.

7. The scroll compressor of claim 3, wherein the first valve receiving groove and the second valve receiving groove at least partially overlap each other when projected in an axial direction.

8. The scroll compressor of claim 2, wherein one of the first variable-capacity unit or the second variable-capacity unit is received in the variable-capacity plate, and wherein another of the first variable-capacity or the second variable-capacity unit is received in the non-orbiting scroll.

9. The scroll compressor of claim 8, wherein a first valve receiving groove is formed in a first side surface of the non-orbiting scroll facing a first side surface of the variable-capacity plate to receive the at least one first variable-capacity valve, and a second valve receiving groove is formed in a second side surface of the variable-capacity plate facing the back pressure chamber assembly to receive the at least one second variable-capacity valve.

10. The scroll compressor of claim 9, wherein a first exhaust passage is formed in the variable-capacity plate and communicates with the first valve receiving groove to be opened and closed by the first variable-capacity opening and closing valve, and a second exhaust passage is formed in the back pressure chamber assembly and communicates with the second valve receiving groove to be open and closed by the second variable-capacity opening and closing valve.

11. The scroll compressor of claim 10, wherein one of the at least one first variable-capacity valve or the at least one second variable-capacity valve is fastened to the back pressure chamber assembly.

12. The scroll compressor of claim 1, wherein at least one of the first variable-capacity unit or the second variable-capacity unit is received in the back pressure chamber assembly.

13. The scroll compressor of claim 12, wherein a first valve receiving groove is formed in a side surface of the non-orbiting scroll facing the back pressure chamber assembly to receive the at least one first variable-capacity valve, and a second valve receiving groove is formed in a side surface of the back pressure chamber assembly facing the non-orbiting scroll to receive the at least one second variable-capacity valve.

14. The scroll compressor of claim 13, wherein a first exhaust passage is formed in the non-orbiting scroll and communicates with the first valve receiving groove to be opened and closed by the first variable-capacity opening and closing valve, and a second exhaust passage is formed in the back pressure chamber assembly and communicates with the second valve receiving groove to be opened and closed by the second variable-capacity opening and closing valve.

15. The scroll compressor of claim 14, wherein one of the at least one first variable-capacity valve or the at least one second variable-capacity valve is fastened to the back pressure chamber assembly.

16. The scroll compressor of claim 1, wherein an overcompression suppressing portion is configured to selectively provide communication between the intermediate pressure chamber or the discharge pressure chamber and the high-pressure portion.

17. The scroll compressor of claim 16, wherein a first variable-capacity control valve and a second variable-capacity control valve are disposed on an outer circumferential surface of the casing, and a first connecting portion is connected between the first variable-capacity opening and closing valve and the first variable-capacity control valve, and a second connecting portion is connected between the second variable-capacity opening and closing valve and the second variable-capacity control valve.

18. A scroll compressor, comprising:

a casing having a hermetic inner space divided into a low-pressure portion and a high-pressure portion;

an orbiting scroll coupled to a rotary shaft in the inner space of the casing to perform an orbiting motion;

a non-orbiting scroll forming compression chambers, each having a suction pressure chamber, an intermediate pressure chamber, and a discharge pressure chamber, together with the orbiting scroll;

a back pressure chamber assembly coupled to the non-orbiting scroll to form a back pressure chamber;

a first variable-capacity unit configured to vary a compression capacity by selectively providing communication between a first intermediate pressure chamber having a first pressure, of the intermediate pressure chambers, and the low-pressure portion; and a second variable-capacity unit configured to vary the compression capacity by selectively providing communication between a second intermediate pressure chamber having a second pressure higher than the first pressure, of the intermediate pressure chambers, and the low-pressure portion, wherein the first variable-capacity unit comprises a first variable-capacity passage that communicates with the first intermediate pressure chamber, at least one first variable-capacity valve that opens and closes the first variable-capacity passage, and a first variable-capacity opening and closing valve that controls opening and closing of the at least one first variable-capacity valve, wherein the second variable-capacity unit comprises a second variable-capacity passage that communicates with the second intermediate pressure chamber, at least one second variable-capacity valve that opens and closes the second variable-capacity passage, and a second variable-capacity opening and closing valve that controls opening and closing of the at least one second variable-capacity valve, wherein the first variable-capacity control valve and the second variable-capacity control valve are disposed on an outer circumferential surface of the casing, and a first connecting portion is connected between the first variable-capacity opening and closing valve and the first variable-capacity control valve, and a second connecting portion is connected between the second variable-capacity opening and closing valve and the second variable-capacity control valve.

19. The scroll compressor of claim 18, wherein a variable-capacity plate is disposed between the non-orbiting scroll and the back pressure chamber assembly, and at least one of the first variable-capacity unit or the second variable-capacity unit is received in the variable-capacity plate.

20. The scroll compressor of claim 18, wherein at least one of the first variable-capacity unit or the second variable-capacity unit is received in the back pressure chamber assembly.

* * * * *